US005241128A

United States Patent [19]

Imaizumi et al.

[11] Patent Number: 5,241,128

[45] Date of Patent: Aug. 31, 1993

[54] AUTOMATIC ACCOMPANIMENT PLAYING DEVICE FOR USE IN AN ELECTRONIC MUSICAL INSTRUMENT

[75] Inventors: Tsutomu Imaizumi; Yashushi Kurakake, both of Hamamatsu, Japan

[73] Assignee: Yamaha Corporation, Hamamatsu, Japan

[21] Appl. No.: 821,023

[22] Filed: Jan. 15, 1992

[30] Foreign Application Priority Data

Jan. 16, 1991 [JP] Japan ..... 3-17040
Jan. 23, 1991 [JP] Japan ..... 3-24005

[51] Int. Cl.[5] ..... G10H 1/06; G10H 1/22; G10H 1/36

[52] U.S. Cl. ..... 84/618; 84/622; 84/626; 84/634

[58] Field of Search ..... 84/609-614, 84/634-638, 615, 618, 622-626

[56] References Cited

U.S. PATENT DOCUMENTS 5,153,361 10/1992 Kozuki ..... 84/613

FOREIGN PATENT DOCUMENTS 1-101299 7/1989 Japan .
2-71293 3/1990 Japan .
2-71294 3/1990 Japan .
2-71295 3/1990 Japan .
2-71296 3/1990 Japan .

*Primary Examiner*—Stanley J. Witkowski
*Attorney, Agent, or Firm*—Spensley Horn Jubas & Lubitz

[57] ABSTRACT

Respecting plural accompaniment patterns belonging to a common accompaniment style, an order is predetermined in which accompaniment patterns are sequentially changed. For example, this order may be predetermined to be an order in which a change of the accompaniment patterns can accomplish a more natural change in an accompaniment tone. Data indicative of a performance state on a keyboard is compared with a predetermined reference value. Whenever a comparison condition is satisfied, change of the accompaniment patterns is effected in the predetermined order. Data related to a changed-over accompaniment pattern is read out from a memory, based on which data an automatic accompaniment tone is generated. There may be a plurality of the predetermined orders. One order may be such that the accompaniment patterns are changed to allow an automatic accompaniment tone to achieve a progressively flourishing mood and another order may be such that brings an effect opposite to that achieved by the one order. Selection may be automatically made of the orders on the basis of a changing trend of the keyboard performance state.

40 Claims, 17 Drawing Sheets

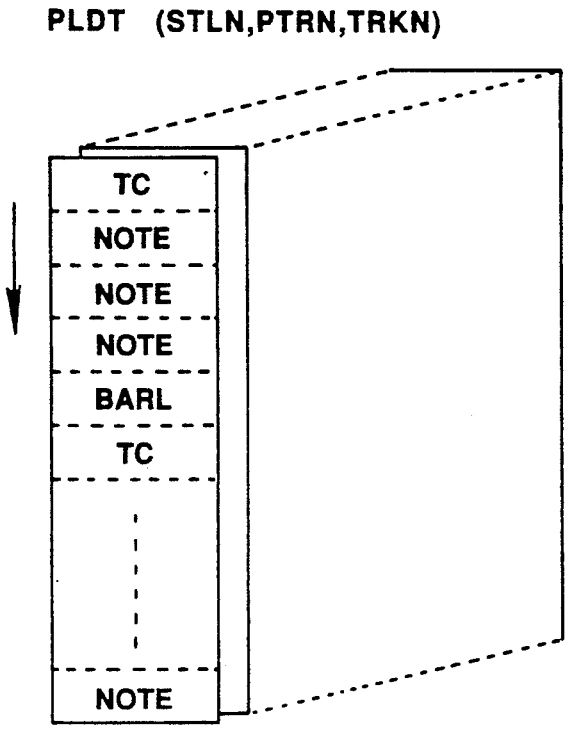
FIG.5(A)
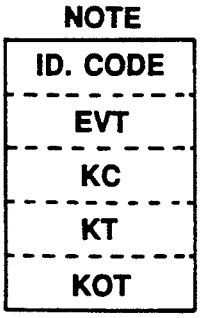
FIG.5(B)
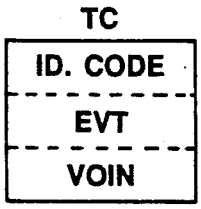
FIG.5(C)
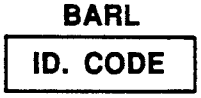
FIG.5(D)
CGCTBL
| SENS | 0 | 1 | 2 |
|---|---|---|---|
| RDNT | 6 | 4 | 3 |
| RDVL | 20 | 15 | 10 |
| RVUP | 85 | 80 | 68 |
| RVDW | 40 | 45 | 55 |
| RNUP | 9 | 7 | 3 |
| RNDW | 4 | 4 | 3 |
| LVUP | 63 | 55 | 43 |
| LVDW | 30 | 30 | 34 |
FIG.6(A)
KTBL
| i | TK(i) |
|---|---|
| 0 | 0.8 |
| 1 | 0.8 |
| 2 | 0.8 |
| 3 | 1.2 |
| 4 | 0.8 |
| 5 | 1.2 |
| 6 | 0.8 |
| 7 | 1.2 |
FIG.6(B)

AUTOMATIC ACCOMPANIMENT PLAYING DEVICE FOR USE IN AN ELECTRONIC MUSICAL INSTRUMENT

BACKGROUND OF THE INVENTION

This invention generally relates to an automatic accompaniment playing device for use in an electronic musical instrument which is capable of sequentially reading out prestored accompaniment pattern data to automatically generate an accompaniment tone such as a chord component tone, bass tone or percussive tone based on the pattern data.

In an accompaniment playing device of the above-mentioned type, as disclosed in for example Japanese Utility Model Laid-open Publication No. Hei 1-101299, plural accompaniment pattern data are prestored in a memory for each accompaniment style such as that of a march or rock, detection is made of an amount indicative of a performance state of a keyboard such as a key touch or key depression time on the keyboard, and different accompaniment pattern data belonging to the same accompaniment style are read out in accordance with the detected performance state so as to change automatic accompaniment patterns.

Further, in those devices disclosed in for example Japanese Patent Laid-open Publication Nos. Hei 2-71293, Hei 2-71294, Hei 2-71295 and Hei 2-71296, detection is made of a keyboard performance state such as a key touch or key depression interval, and the detected keyboard performance state is compared with a predetermined reference value. When the keyboard performance state exceeds the reference value, an accompaniment pattern data to be read out from an accompaniment data memory is changed. With this arrangement, an accompaniment pattern is automatically changed, so that an accompaniment tone suitable for a played music piece can be produced and also undesirable monotonousness in the accompaniment tone can be avoided.

However, the prior art devices are disadvantageous in that the accompaniment pattern tends to change too greatly as the keyboard performance state changes greatly and this creates unnatural flow of the automatic accompaniment. Further, since the reference value with which the keyboard performance state is compared is a constant value, and thus a detected keyboard performance state is caused to change in response to the change in the mood of a music piece played, player's habit or inclination, or in a tone color of a played tone, the accompaniment patterns tend to be changed too frequently in the course of playing of the music piece, or otherwise the accompaniment patterns tend to be changed too rarely. This creates the problem that the accompaniment pattern change can not be effected at a proper frequency.

SUMMARY OF THE INVENTION

Therefore, it is an object of the present invention to provide an electronic musical instrument which allows accompaniment patterns to be changed in a natural order in accordance with a performance state of performance operation means such as a keyboard even in the course of an automatic accompaniment action, so as to produce an automatic accompaniment tone which is rich in musical expression.

It is another object of the present invention to provide an electronic musical instrument which allows accompaniment patterns to be properly changed in accordance with a performance state of performance operation means such as a keyboard even in the course of playing of a music piece.

To achieve one object of the present invention, an electronic musical instrument according to the invention comprises: a data memory section for storing plural accompaniment pattern data; a reading section for reading out from said data memory section one of the plural accompaniment pattern data; a performance operating member section whose operation controls a tone to be generated; a performance state detecting section for detecting a performance state carried out on said operating member section and producing performance state data representing the detected performance state; a comparing section for comparing the performance state data with a predetermined reference value; a pattern changing section for changing accompaniment pattern data to be read out from said data memory, from accompaniment pattern data being currently read out to another one of the plural accompaniment pattern data in response to a result of comparison by said comparing section, said another accompaniment pattern data being determined in accordance with a predetermined priority order given to said plural accompaniment pattern data, and accompaniment tone signal generating section for generating an accompaniment tone signal in accordance the accompaniment pattern data read out from said data memory section.

With this electronic musical instrument, for a predetermined number of plural accompaniment patterns among those belonging to a common accompaniment style, a priority order is predetermined in accordance which one accompaniment pattern is to be changed to another. For example, this priority order may be predetermined to be such an order that a change of the accompaniment patterns allows an accompaniment tone to be changed in a more natural manner. Performance state data representing a performance state on a keyboard is compared with a predetermined reference value. In accordance with a result of the comparison, the pattern changing section gives instructions to cause the accompaniment patterns to be changed in the priority order. Then, one accompaniment pattern data designated by the pattern changing section is read out from the data memory section, and an automatic accompaniment tone is generated thereon. Since the automatic accompaniment patterns can thus be changed in response to the performance state to be well fitted for the latter, and also the order in which the accompaniment patterns are changed is predetermined, an automatic accompaniment can be changed in a natural flow, and besides it is possible to provide an automatic accompaniment which is excellent in musical quality and also rich in variety. In contrast, with the above-discussed prior art devices, the performance state and corresponding accompaniment pattern are connected with each other in a fixed one-to-one relation. Accordingly, when, for example, the performance state changes greatly, the accompaniment pattern tends to be changed in an excessively great degree, and this creates undesirable unnaturalness in the flow of the automatic accompaniment performance.

For example, the pattern changing section may effect the pattern change in one of plural priority orders. In a preferred embodiment to be detailed later, the pattern change may be effected in two opposite orders, one order being for increasing the flourishing or rising mood, the other being for the opposite effect, i.e., for decreasing or subduing the flourishing mood. Further, in the preferred embodiment, the accompaniment patterns constituting or associated with one such order may come in four, one being a first accompaniment pattern, another being a second accompaniment pattern, another being a first accompaniment pattern for an arrange-mode, the other being a second accompaniment pattern for an arrange-mode. The second accompaniment patterns may be those which achieve more of the flourishing mood than the first accompaniment patterns. In the arrange-mode, one or more additional tones are added to each accompaniment tone to increase the flourishing mood. In other words, the four accompaniment patterns can be said to be made up of two normal patterns (first and second accompaniment patterns) and two arrange-patterns (first and second accompaniment patterns for the arrange-mode). However, it is a matter of course that the priority order and type of the accompaniment patterns are not limited to those described in the embodiment.

To achieve one object of the present invention, an electronic musical instrument according to the invention comprises: a data memory section for storing plural accompaniment pattern data; a reading section for reading out from said data memory section one of the plural accompaniment pattern data; a performance operating member section whose operation controls a tone to be generated; a performance state detecting section for detecting a performance state carried out on said operating member section and producing performance state data representing the detected performance state; a comparing section for comparing the performance state data with a predetermined reference value; a pattern changing section for changing accompaniment pattern data to be read out from said data memory, from accompaniment pattern data being currently read out to another one of the plural accompaniment pattern data in response to a result of comparison by said comparing section, said another accompaniment pattern data being determined based on said currently read out accompaniment pattern, and accompaniment tone signal generating section for generating an accompaniment tone signal in accordance the accompaniment pattern data read out from said data memory section.

With this electronic musical instrument, such another accompaniment pattern data is determined based on the currently read out accompaniment pattern, and thus the automatic accompaniment patterns can be changed in response to the performance state to be well fitted for the latter. Because of this, an accompaniment can be changed in a natural flow, and besides it is possible to provide an automatic accompaniment which is excellent in musical quality and also rich in variety. In contrast, with the above-discussed prior art devices, the performance state and corresponding accompaniment pattern are connected with each other in a fixed one-to-one relation. Accordingly, when, for example, the performance state changes greatly, the accompaniment pattern tends to be changed in an excessively great degree, and this creates undesirable unnaturalness in the flow of the automatic accompaniment performance.

For example, the performance state detecting section detects a performance state related to a predetermined performance operation factor of the performance operation section over a predetermined period, and produces performance state data representing the detected performance state. The above-mentioned period may be determined as a matter of design choice and may for example be a time between the current performance time point and a time point preceding the current performance time point by a predetermined time, a period between the current performance time point and a time point preceding the current performance time point by a predetermined number of beats, a period established for each predetermined number of beats, or a period established for each predetermined number of bars. In the embodiment to be detailed later, a period that is established regularly for each predetermined number of beats or for each predetermined number of bars for the purpose of performance state detection will be referred to as a "frame". The performance operation factor to be detected over such period or frame may be the number of depressed key on a keyboard (depressed key number), degree or intensity of a key touch on the keyboard or the like.

Further, by way of example, the electronic musical instrument further includes an index making section for making an increase/decrease index that indicates whether the performance state detected by said performance state detecting section is in an increasing trend or in a decreasing trend with respect to the predetermined reference value, and a pattern controlling section for controlling a manner of the change of the plural accompaniment patterns in accordance with the increase/decrease index. In the embodiment to be detailed later, an up-going routine (a routine to achieve a change for progressively increasing the flourishing mood) may be carried out when the performance state is in the increasing trend, and a down-going routine (a routine to achieve a change for progressively subduing the flourishing mood) may be carried out when the performance state is in the decreasing trend.

Moreover, to achieve another object of the present invention, an electronic musical instrument according to the invention comprises: a data memory section for storing plural accompaniment pattern data; a reading section for reading out from said data memory section one of the plural accompaniment pattern data section; a performance operating member section whose operation controls a tone to be generated; a performance state detecting section for detecting a performance state carried out on said operating member section and producing performance state data representing the detected performance state; a comparing section for comparing the performance state data with a predetermined reference value; a pattern changing section for changing accompaniment pattern data to be read out from said data memory, from accompaniment pattern data being currently read out to another one of the plural accompaniment pattern data in response to a result of comparison by said comparing section, said another accompaniment pattern data being determined under a predetermined change condition, and a sensitivity adjusting section for changing said predetermined change condition to another change condition, so as to adjust sensitivity of accompaniment pattern change.

In such electronic musical instrument, the performance state data representing the performance state of the performance operating member section is compared with the predetermined reference value, and in accordance with the result of the comparison, a control for changing the accompaniment patterns is performed by the pattern changing section. Then, one accompaniment pattern data designated through the pattern change control is read out from the data memory section, and an automatic accompaniment tone is generated thereon. A condition under which the pattern change is effected in the pattern changing section can be altered by the sensitivity adjusting section, and thus sensitivity of accompaniment pattern change control can be adjusted. For example, even if the performance state of the performance operating member section remains unchanged, the pattern change may be or may not be effected depending on the degree of the sensitivity adjustment. Accordingly, proper control of the pattern change can be achieved by properly adjusting the sensitivity in consideration of various factors (such as a mood of a music piece played, tone color or trend of flow of performance). Therefore, the automatic accompaniment pattern can be changed in response to the performance state to be well fitted for the latter, and also a manner in which the automatic accompaniment pattern is changed can be controlled in a variety of ways, with the results that it is allowed to provide an automatic accompaniment which is excellent in musical quality and also rich in variety. Such sensitivity adjusting control is applicable not only to the above-mentioned case where accompaniment patterns are sequentially changed in a predetermined order but also to any other cases where other types of pattern changes are performed.

The sensitivity adjusting section may include a change condition selecting section for selecting one change condition from plural stages of change conditions and a modifying section for modifying at least one of the reference value and performance state data in accordance with the change condition selected by the change condition selecting section, so that a value of input data to said comparing section is changed with the result that a pattern change condition in the pattern changing section is changed. With this arrangement, a change condition can be selected as desired by the player, and thus an automatic accompaniment rich in expression can be achieved.

The sensitivity adjusting section may include a tone color designating section for designating a tone color of a tone to be generated and a modifying section for modifying at least one of the reference value and performance state data in accordance with the tone color designated by the tone color designating section. In this arrangement, the pattern change condition can be automatically altered in accordance with a tone color of a tone to be generated, and therefore it is possible to achieve an automatic accompaniment change fitted for a tone color of a tone played. There are some tone colors which allow us to predict a performance state with considerable accuracy. For example, a performance in a tone color of the strings frequently may involve slow playing of the stringed instrument part or scarce variation of playing touch. Thus, change in the performance state data tends to be scarce as compared with that in performances of other tone colors, and it is not preferable to perform the change control employing the same condition for all tone colors. Therefore, in the embodiment to be described later, arrangements are made such that, when a tone color of the strings is designated, the pattern change condition is automatically modified to achieve a proper change in the automatic accompaniments. It should however be understood that the present invention is not confined to the embodiment.

The sensitivity adjusting section may comprise a change evaluation value generating section for generating a change evaluation value that differs depending on whether or not the accompaniment pattern has been changed in a predetermined previous frame, and a modifying section for modifying at least one of the reference value and performance state data in accordance with the change evaluation value. With this arrangement, because different change evaluation values are generated depending on the presence or absence of the accompaniment pattern change in the predetermined previous frame, and at least one of the reference value and performance state data is changed in accordance with the generated change evaluation value, the frequency of the accompaniment pattern change can be controlled in a proper manner. If a pattern change has been effected in a most recent predetermined previous frame, there may be generated such a change evaluation value that minimizes the possibility of the pattern change, so that the higher frequency of the pattern change can result in the lesser control of the pattern change. This enables a proper control of the pattern change.

As described earlier, the performance state detecting section may detect the number of depressed keys or degree of the key touch in a predetermined frame. In such a case, the key touch degree may be an average key touch degree, or maximum or minimum key touch degree value in the frame. Further, the performance state detecting section may detect a difference of the depressed keys or a difference of the average key touch degrees between different frames. The performance state data may represent one factor of the detected performance state, or may comprise a suitable combination of plural factors of the detected performance state.

Furthermore, to achieve still another object of the present invention, an electronic musical instrument according to the invention comprises: a first performance operating member section whose operation controls a first tone to be generated; a second performance operating member section whose operation controls a second tone to be generated; a data memory section for storing plural accompaniment pattern data; a reading section for reading out one of the plural accompaniment pattern data from said data memory section; a first tone signal generating section for generating a tone signal corresponding to said first tone; a second tone signal generating section for generating a tone signal corresponding to said second tone in accordance with the accompaniment pattern data; a first performance state detecting section for detecting a performance state carried out on said first performance operating member section and producing first performance state data representing the detected performance state; a second performance state detecting section for detecting a performance state carried out on said second performance operating member section and producing second performance state data representing the detected performance state; a selecting section for selecting one of said first and second performance state data; a comparing section for comparing the selected performance state data with a predetermined reference value, and a pattern changing section for changing accompaniment pattern data to be read out from said data memory, from accompaniment pattern data being currently read out to another one of the plural accompaniment patterns in accordance with a result of comparison by said comparing section.

In this electronic musical instrument, selection can be made as to which of the performance states of the first and second performance operating member sections should be utilized for the pattern change control. With the second performance operating member section, a performance for controlling an accompaniment tone such as a performance for designating a chord is performed. With the first performance operating member section, another performance such as a melody performance which is different from that performed by the second performance operating member section can be performed. Because of this, selection can be freely made as to whether the accompaniment pattern change control is to be effected in accordance with the state of one performance for controlling an accompaniment tone generation, or the accompaniment pattern change control is to be effected in accordance with the state of the other performance (for example, a melody performance) performed in parallel with the accompaniment performance. This allows an automatic change of the accompaniment patterns to be effected properly in a variety of ways. Since the performance state data input into the comparing section varies depending on which of the performance states is selected, the frequency of the accompaniment pattern change can be adjusted in a proper manner. For example, proper selection is possible in such manner that either one of the performance states is selected in the case where it is desired to increase the frequency of the accompaniment pattern change, and the other of the performance states is selected in the opposite case.

There may be further included a data making section for making a third performance state data. In such a case, one of the first, second and third performance state data is selected by the selecting section.

The preferred embodiments will now be described in detail with reference to the accompanying drawings.

BRIEF DESCRIPTION OF THE DRAWINGS

In the drawings:

FIG. 5A is a diagram showing a data format of a performance data table stored in the accompaniment data memory;

FIG. 5(B) is a diagram showing a data format of note data stored in the performance data table;

FIG. 5(C) is a diagram showing a data format of tone color data stored in the performance data table;

FIG. 5(D) is a diagram showing a data format of bar line data stored in the performance data table;

FIG. 6A shows a data format of a change condition table stored in the accompaniment data memory;

FIG. 6(B) shows a data format of a tone color coefficient table stored in the accompaniment data memory;

DETAILED DESCRIPTION OF THE PREFERRED EMBODIMENT

Figure 1:
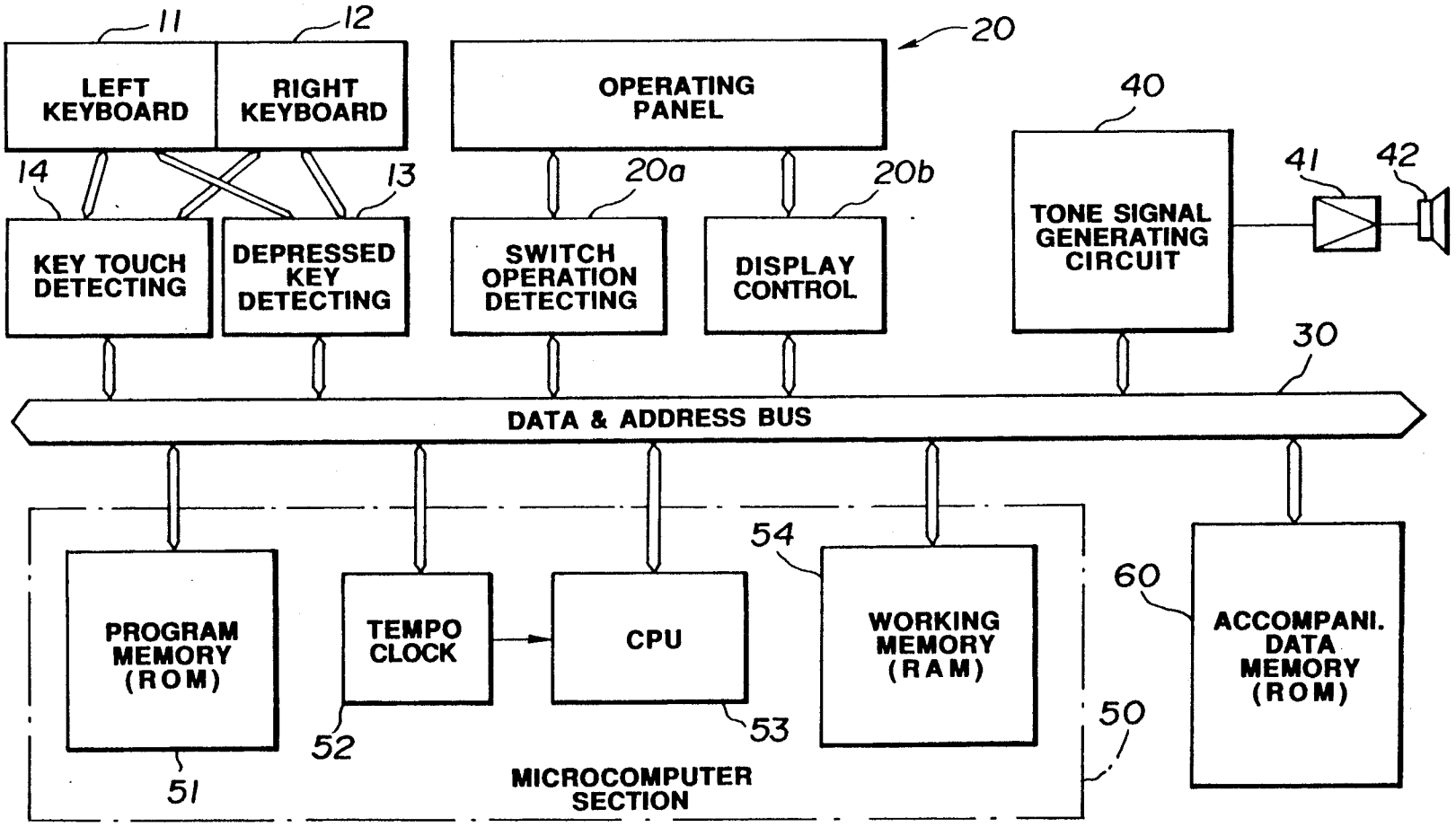
FIG. 1 is a block diagram of an electronic musical instrument provided with an automatic accompaniment playing device according to an embodiment of the present invention.

FIG. 1 shows an electronic musical instrument according to an embodiment of the invention which comprises a left keyboard 11, a right keyboard 12 and an operating panel 20. The left keyboard 11, which has a plurality of keys, is used for playing a chord. The right keyboard 12, which also has a plurality of keys, is used for playing a melody. A key depression detecting circuit 13 incorporates therein a plurality of key switches provided in corresponding relation to the keys of the keyboards 11, 12 and detects the depression and release of the individual keys based on the closing (ON) and opening (OFF) of the key switches. A key touch detecting circuit 14 detects a key touch (initial key touch) of a depressed key.

Figure 2:
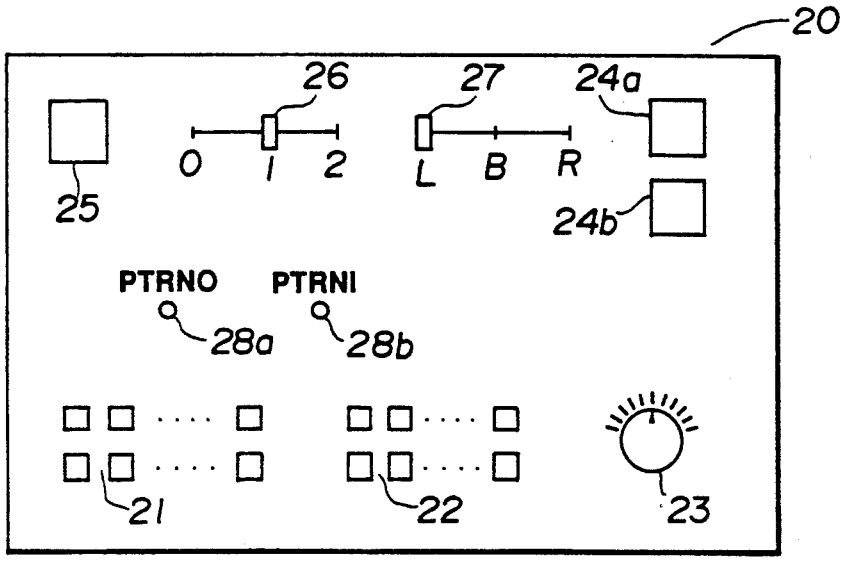
FIG. 2 is a detailed view of an operating panel shown in FIG. 1.

As shown in FIG. 2, the operating panel 20 includes groups of tone color selecting switches 21 and accompaniment style selecting switches 22, a tempo volume setting switch 23, a start switch 24*a*, a stop switch 24*b*, a pattern change selecting switch 25, a pattern change condition setting switch 26, a determination area setting switch 27 and two lamps 28*a*, 28*b*.

The tone color selecting switches 21 are provided in corresponding relation to plural tone colors such as those of violin guitar and piano in such a manner that each of the selecting switches 21*a* can be used to designate one of the plural tone colors for a melody tone. The accompaniment style selecting switches 22 are provided in corresponding relation to plural accompaniment styles such as those of a march and rock in such a manner that each of the section switches 22 can be used to designate one of the plural accompaniment styles. The tempo setting switch 23 is for setting a tempo of automatic accompaniment. The start switch 24*a* is provided for instructing the start of automatic accompaniment, and the stop switch 24*b* is provided for instructing the stop of automatic accompaniment. The pattern change selecting switch 25 is provided for selecting whether or not an accompaniment pattern is to be automatically changed during the performance of automatic accompaniment in accordance with a keyboard performance state (key touch or depressed key number). The pattern change condition setting switch 26 is for variably setting one of three different values as a reference value of the keyboard performance state, in accordance with which an accompaniment pattern is automatically changed. The determination area setting switch 27 is provided for selecting whether the change of the accompaniment patterns is to be done in accordance with the performance state of the left keyboard 11, or in accordance with the performance state of the right keyboard 12, or in accordance with the performance states of both the left and right keyboards 11, 12. The lamps 28*a*, 28*b* are composed of light-emitting diodes and operate to display a pattern (first or second pattern) of an accompaniment which is being currently played. Further, a switch operation detecting circuit 20*a* detects the operations of these switches 21–27, and a display controlling circuit 20*b* controls the ON/OFF of the lamps 28*a*, 28*b*.

The key depression detecting circuit 13, switch operation detecting circuit 20*a* and display controlling circuit 20*b* are connected to a bus 30, to which a tone signal generating circuit 40, a microcomputer section 50 and an accompaniment data memory 60 are also connected.

The tone signal generating circuit 40 includes a plurality of tone signal generating channels. On the basis of various control data including a key code KC, volume data VOL, a key-on signal KON etc., each of the channels is capable of generating a melody tone signal and an accompaniment tone signal for a tone such as that of piano or clarinet which has a variable pitch and also capable of generating and outputting a percussive tone signal (defined as a part of the accompaniment tone signal in this invention) for a tone such as that of drum or cymbal. The output of the tone signal generating circuit 40 is connected to a speaker 42 via an amplifier 41.

The microcomputer section 50 includes a program memory 51, a tempo clock generator 52, a CPU 53 and a working memory 54, each of which is connected to the bus 30. The program memory 51, which is in the form of a ROM, stores therein various programs that correspond to flowcharts shown in FIGS. 8–25. The tempo clock generator 52, which is in the form of a variable frequency oscillator, generates a tempo clock signal at a frequency corresponding to tempo control data that is supplied from the CPU 53 via the bus 30. In this embodiment, the frequency of the tempo clock signal corresponds to a timing of 1/24 of a quarter tone. Upon switch-on of a power source switch (not shown), the CPU 53 starts repeatedly carrying out a main program corresponding to the flowchart shown in FIG. 8. Each time a tempo clock signal is given from the tempo clock generator 52, the CPU 53 interrupts the main program to carry out an interrupt program corresponding to the flowchart shown in FIG. 13. The working memory 54, which is in the form of a RAM, is provided for temporarily storing various data that are necessary for carrying out the above-mentioned programs.

An accompaniment data memory 60, which is in the form of a ROM, contains a style table STLTBL, a pattern table PTNTBL, a performance data table PLDT, a pattern change condition table CGCTBL and a coefficient table KTBL, and it also has an storage area for storing other accompaniment-related data.

Figure 3:
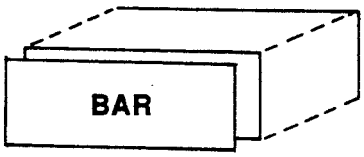
FIG. 3 is a diagram showing a data format of a style table stored in an accompaniment data memory shown in FIG. 1.

As shown in FIG. 3, the style table STLTBL is divided into plural storage areas STLTBL (STLN) that can be designated by respective styles number STLN representative of various accompaniment styles. In each of the storage areas STLTBL (STLN), there are stored bar numbers BAR each representing the number of bars or measures contained within one cycles of first and second accompaniment patterns of a corresponding accompaniment style. In an automatic accompaniment device according to this embodiment, first and second patterns are provided for each of the accompaniment styles. The second pattern gives more flourishing mood than the first pattern.

Figure 4:
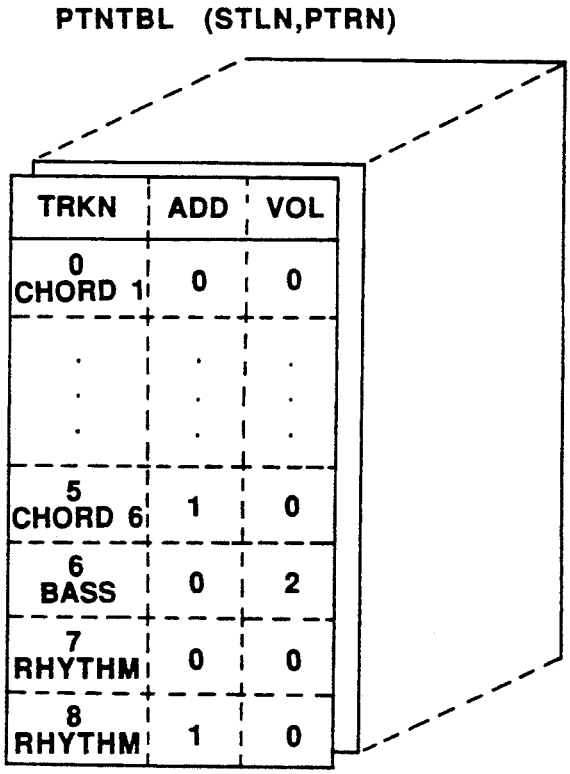
FIG. 4 is a diagram showing a data format of a pattern table stored in the accompaniment data memory.

As shown in FIG. 4, the pattern table PTNTBL is divided into plural storage areas PTNTBL (STLN, PTRN), each of which corresponds to accompaniment patterns (first and second accompaniment patterns) of an accompaniment style and can be designated by a style number STLN and a pattern number PTRN (0 or 1). In each of storage areas PTNTBL (STLN, PTRN), there are stored a tone addition flag ADD as well as volume data VOL for each track number (0–8). Track numbers 0–5 represent a row of chord component tones, track number 0 represents a row of bass tones, and track number 7 and 8 represent a row of percussive tones. In addition, the tone addition flag ADD indicates by "0" that an accompaniment tone of a respective track is a normal tone and indicates by "1" that the accompaniment tone of the corresponding track is an additional tone. It is to be noted here that the normal tone is a tone which is normally sounded in the first and second accompaniment patterns and the additional tone is a tone which is sounded only in an arrange-mode (when an arrange-flag ARNG is "1") of the first and second accompaniment patterns. The volume data VOL is representative of a relative volume of an accompaniment tone of a respective track.

As shown in FIG. 5A, the performance data table PLDT is divided into plural storage areas PLDT (STLN, PTRN, TRKN), each of which corresponds to an accompaniment style, an accompaniment pattern (first and second accompaniment patterns) and a track and can be designated by a style number STLN, a pattern number PTRN and a track number TRKN. In each of the storage areas PLDT (STLN, PTRN, TRKN), various performance data are stored for each track in sequence, namely, in the order of time lapse. Such performance data include note data NOTE, tone color data TC and bar line data BARL. The note data NOTE is, as shown in FIG. 5(B), composed of a set of data including an identification code, event time data EVT, a key code KC, key touch data KT and key-on time data KOT. In the illustrated example, the identification code indicates that this set of data is note data NOTE, and the event time data EVT indicates a read-out timing of the data NOTE in the form of a time as measured from the starting point of a bar. Further, the key code KC indicates a pitch of an accompaniment tone which is a pitch expressed by the unit of a semitone in relation to the C note that is a root note of the C major chord (as regards a percussive tone, however, it indicates its type), the key touch data KT indicates a relative volume of an accompaniment tone, and the key-on time data KOT indicates a duration of an accompaniment tone. As shown in FIG. 56, the tone color data TC is composed of a set of data including an identification code, event time data and a tone color number VOIN. In the illustrated example, the identification code indicates that this set of data is tone color data TC, the event time data EVT indicates a read-out timing of the data NOTE in the form of a time as measured from the starting point of a bar, and the tone color number VOIN indicates a tone color of an accompaniment tone (as regards a percussive tone, however, it indicates a subtle variation of an identical tone). The bar line data BARL as shown in FIG. 5(D) is composed solely of an identification code indicating that a train of accompaniment tones is at the end of a bar.

As shown in FIG. 6(A), the pattern change condition table CGCTBL stores therein eight kinds of reference values RDNT, RDVL, RVUP, RVDW, RNUP, RNDW, LVUP, LVDW in correspondence to three levels of change sensitivity SENS (0–2) which can be selectively established by means of the pattern change condition setting switch 26. The reference value RDNT is a value for changing the accompaniment patterns in accordance with the difference of the respective numbers of depressed keys between two succeeding frames (in this embodiment, each of the frames corresponds to a length of one bar) of the right keyboard 12. The reference value RDVL is a value for changing the accompaniment patterns in accordance with the difference of respective average key touch amounts between two succeeding frames of the right keyboard 12. The reference value RVUP is a value for changing the accompaniment patterns in a flourishing direction in accordance with the magnitude of an average key touch amount of one frame of the right keyboard 12. The reference value RVDW is a value for changing the accompaniment patterns in an opposite or subduing direction in accordance with the magnitude of an average key touch amount of one frame of the right keyboard 12. Likewise, the reference values LVUP, LVDW are values for changing the accompaniment patterns in the flourishing and subduing directions, respectively, in accordance with the magnitude of an average key touch amount of one frame the left keyboard 11.

As shown in FIG. 6(B), the coefficient table KTBL stores therein table coefficients TK (i) (i=0–7) that correspond to the above-mentioned eight reference values RDNT, RDVL, RVUP, RVDW, RNUP, RNDW, LVUP, LVDW. These table coefficients TK (i) are multiplied by the respective ones of the reference values RDNT, RDVL, RVUP, RVDW, RNUP, RNDW, LVUP, LVDW in the case where the tone color of a melody tone is that of the strings.

In the area for storing other accompaniment data, there are stored a chord detection table to be used for detecting a chord and a conversion table to be used for converting an accompaniment tone into a component tone of a detected chord on the basis of the last-mentioned.

Next, operation of the embodiment will be described with reference to the flowcharts as shown in the drawings.

In response to the actuation of the power source switch, the CPU 53 start carrying out the main program in step 100 and sets the tone signal generating circuit 40 and working memory 54 to initialized conditions. Particularly, in such initialization step, the pattern number PTRN is set to "0", a change evaluation coefficient CF to "1", and tone color coefficients K(i) (i=0–7) are set to "1". Each of the coefficients CF, K(i) is used for evaluation of an automatic change of the accompaniment patterns, and the change evaluation coefficient CF is set to "1" when the accompaniment pattern change has been effected in the previous frame and is set to "1.5" when the accompaniment pattern change has not been effected in the previous frame. The tone color coefficient K(i) is set to the table tone color coefficient TK(i) in the case where the tone color of a melody tone is that of the strings, but it is set to "1" in the case where the tone color of a melody tone is other than that of the strings. After such initialization, the CPU 53 continues to carry out a cycle of steps 104 to 110 in a repeated manner.

Figure 9:
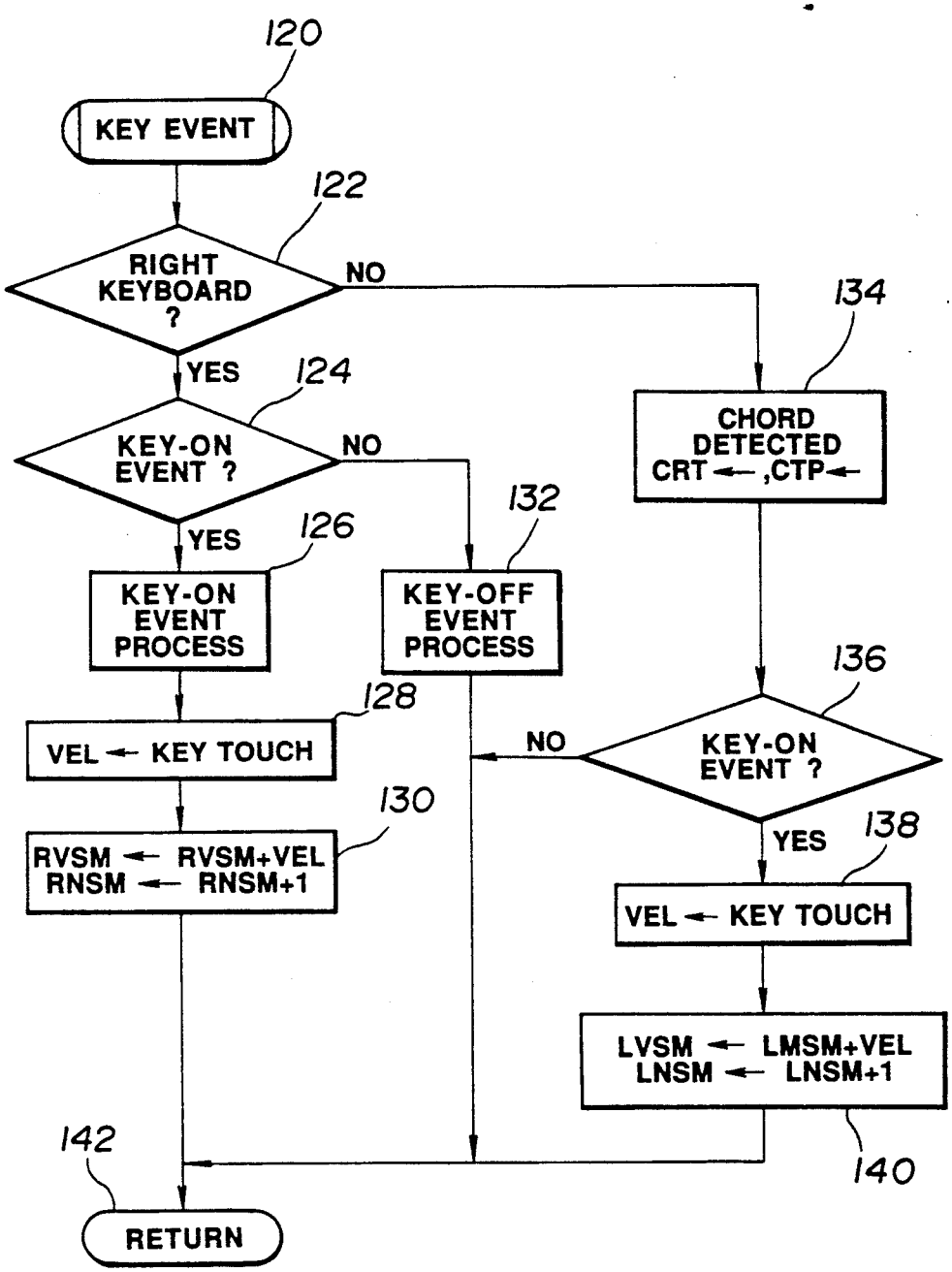
FIG. 9 is a detailed flowchart of a key event routine of FIG. 8.

When any of the keys on the left and right keyboards 11, 12 is depressed during the cycle of steps 104 to 110, the CPU 53 determines in step 104 that there is a key event and then carries out a "key event routine" in step 106. This key event routine, as shown in FIG. 9, comprises steps 120 to 142 and is intended for controlling generation of a melody tone in accordance with the performance on the left and right keyboards 11, 12 and a chord being played is detected.

When there is a depression of a key on the right keyboard 12, determinations in steps 122 and 124 by the CPU 53 becomes "YES", and the CPU 53 carries out a key-on event process in step 126. In the key-on event process, a key-on signal KON indicative of a key depression, a key code KC indicative of the name of the depressed key KC and a key touch signal KT indicative of the intensity of a key touch detected by the key touch detecting circuit 14 are outputted to the tone signal generation circuit 40. Thus, the tone signal generation circuit 40 generates a melody tone signal which is of a pitch indicated by the key code KC and of a volume corresponding to the key touch signal KT, and it outputs the thus-generated tone signal to the speaker 42 through the amplifier 41. It is to be noted that the tone color of the melody tone signal is determined based on operation of the tone color selecting switch group by a later-described process. After the key-on event process in step 126, the value indicative of the intensity of the key touch is established as a key touch detection value VEL in step 128, and the key touch detection value VEL is added to the key touch amount RVSM for the right keyboard 12 in step 130, and also "1" is added to the depressed key number RNSM for the right keyboard 12. It should be appreciated that the key touch amount RVSM is a variable for accumulating individual key touch intensities on the right keyboard 12 within one bar, and the depressed key number RNSM is a variable for accumulating individual key depressions on the right keyboard 12 within one bar, so are the key touch amount LVSM and depressed key number LNSM on the left keyboard 11.

When there is a release of a key on the right keyboard 12, the determination results in steps 122 and 124 become "YES" and "NO", respectively, so that a key-off event process is carried out in step 132. In this key-off event process, a key code KC indicative of the name of the released key and a key-off signal KOF are outputted to the tone signal generating circuit 40, which in turn stops generating a melody tone signal which is of a pitch indicated by the key code KC.

In this manner, when any of the keys on the right keyboard 12 is depressed, a melody tone is sounded from the speaker 42 in response to the depression, and the key touch amount RVSM and depressed key number RNSM are renewed in response to the key depression.

On the other hand, when any of the keys on the left keyboard 11 is depressed or released, the CPU 53 makes "NO" determination in step 122 and carries out a chord detection process in step 134. In the chord detection process, a chord detection table in the accompaniment data memory 60 is consulted on the basis of the combination of the keys being depressed on the left keyboard 11, so as to detect the chord, and data indicative of the root and type of the detected chord are stored as a code root CRT and a chord type CTP. Following this chord detection process in step 134, if the key operation on the left keyboard 11 is a key depression, determination in step 136 becomes "YES", based on which processes of steps 138 and 140 similar to those of the above-mentioned steps 128, 130 are implemented so as to renew the key touch amount LVSM and depressed key number LNSM for the left keyboard 11.

Figure 8:
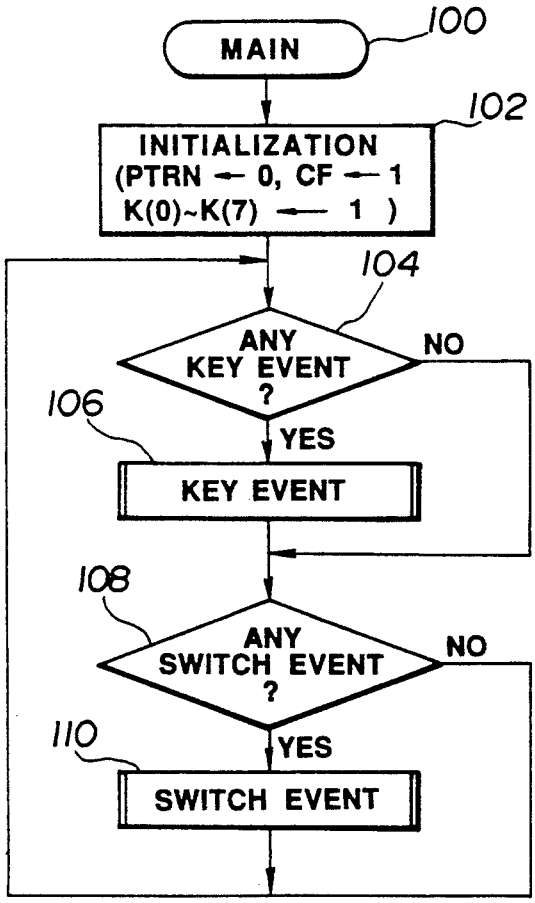
FIG. 8 is a flow chart of a main program carried out by a microcomputer section of FIG. 1.

When any of the switches on the operation panel 20 is operated during the cycle of steps 104 to 110 shown in FIG. 8, the CPU 53 determines in step 108 that there is a switch event, and it carries out a "switch event routine" in step 110. This switch event routine, as shown in detail in FIG. 10, comprises steps 150 to 174 and is intended for establishing the tone color of a melody tone and controlling generation of an accompaniment tone.

When any of the tone color selecting switches 21 is operated, the CPU 53, in accordance with a determination result in step 152, advances to step 154 in which it outputs to the tone signal generating circuit 40 tone color number data VOIN indicative of the operated tone color selecting switch 21. Following step 154, if the tone color of a melody tone selected by means of the tone color selecting switches 21 is that of the strings, the CPU 53 makes "YES" determination in step 156 and then consults the coefficient table KTBL (FIG. 5(B)) so as to set the tone color coefficients K(i) (i=0–7) to the table tone color coefficient values TK(i) (i=0–7), respectively. If, on the other hand, the tone color of the melody tone selected by means of the tone color selecting switches 21 is other than that of the strings, the CPU 53 makes "NO" determination in step 156 and then advances to step 158 so as to set each tone color coefficients K(i) to "1".

When any of the accompaniment style selecting switches 22 is operated, the CPU 53, in accordance with the determination result in step 152, advances to step 161 in which the value indicative of the operated accompaniment style switch 22 is established as a style number STLN. Then, the CPU 53 advances to step 162 in which, based on a current bar CBAR as well as a current timing CTIM, nine pointers are established for addressing the performance data storage areas PLDT(STLN, PTRN, 0) to PLDT(STLN, PTRN, 8) for each track designated by the style number STLN and the pattern number PTRN. It should be appreciated that the current bar CBAR represents a current bar values 0 to n−1 (n is the number of bars corresponding to a repetition cycle of a respective pattern), while the current timing CTIM represents a current timing in a respective bar as measured by the unit of 1/24 of a quarter tone. It should also be appreciated that the process of step 162 is normally not required in view of step 202 shown in FIG. 12 to be described later, but in the case where any of the accompaniment style selecting switches 22 is operated in the course of an automatic accompaniment performance, the process of step 162 is required for properly initiating an automatic accompaniment performance of a newly designated accompaniment style at a right position.

When the tempo setting switch 23 is operated, the CPU 53, in accordance with the determination result in step 152, advances to step 160 so as to effect a tempo setting process. In this a tempo setting process, tempo control data corresponding to a current operating position of the tempo setting switch 23 is outputted the tempo clock generator 52, which provides tempo clock signals at a frequency corresponding to the tempo control data as mentioned earlier.

When the start switch **24*a* is operated, the CPU 53, in accordance with the determination result in step 152, sets a run flag RUN to "1" in step 166 and then carries out a "pattern initiation routine" in step 168 in order to initiate an automatic accompaniment action. On the other hand, when the stop switch 24*b* is operated, the CPU 53, in accordance with the determination result in step 152, sets the run flag RUN to "0" in step 170 and then in step 172 effect a tone extinguishing process for the tone signal generating circuit 40** in order to stop the automatic accompaniment action. The run flag RUN indicates by "0" that an automatic accompaniment operation is being stopped and indicates by "1" that an automatic accompaniment action is being performed.

When the selecting switch 25 is operated, the CPU 53, in accordance with the determination result in step 152, inverts a change selection flag CNGF (from "1" to "0", or from "0" to "1"). In this case, the change selection flag CNGF indicates by "1" a mode in which an accompaniment pattern is automatically changed to another in accordance with the key touch and depressed key number, namely, key depression states of the left and right keyboards 11, 12 and indicates by "0" a mode in which such automatic change of the accompaniment patterns is prohibited.

When the change condition setting switch 26 is operated, the CPU 53, in accordance with the determination result in step 152, advances to step 163 for setting a change sensitivity SENS to a value (0–2) corresponding to an operating position of the switch 26.

Further, when the determination area setting switch 26 is operated, the CPU 53, in accordance with the determination result in step 152, advances to step 164 for setting a determination keyboard area flag RNG to a value (0–2) corresponding to an operating position of the switch 27. This determination keyboard area flag RNG indicates the left keyboard 11 by "0", the right keyboard 12 by "1" and both the keyboards 11, 12 by "2".

Next, detailed description will be made on an automatic accompaniment action based on the operation of the keyboards 11, 12 and individual switches of the operating panel 20.

First of all, description will be made on the action when the change selection flag CNGF is set at "0".

Figure 10:
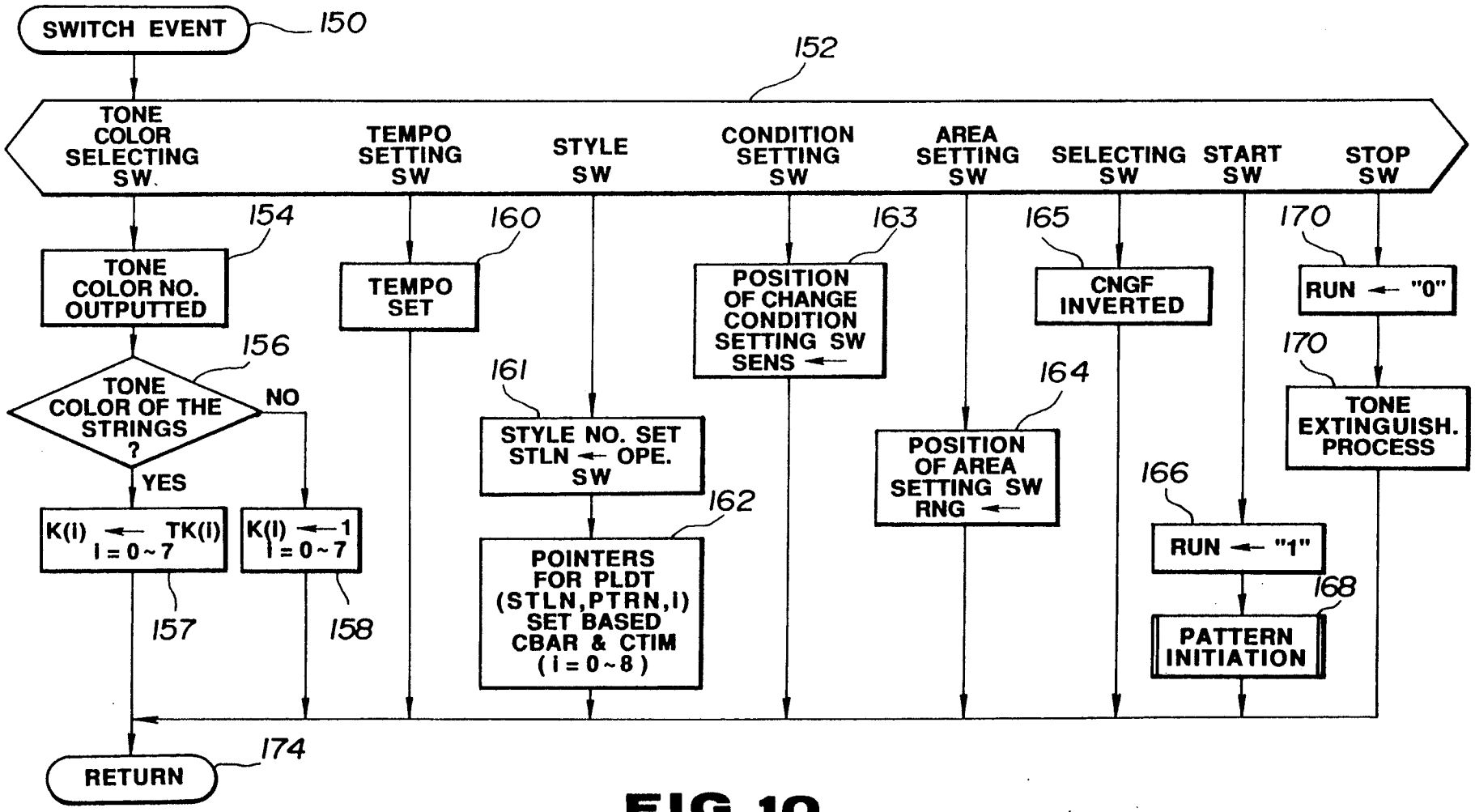
FIG. 10 is a detailed flowchart of a switch event routine of FIG. 8.
Figure 11:
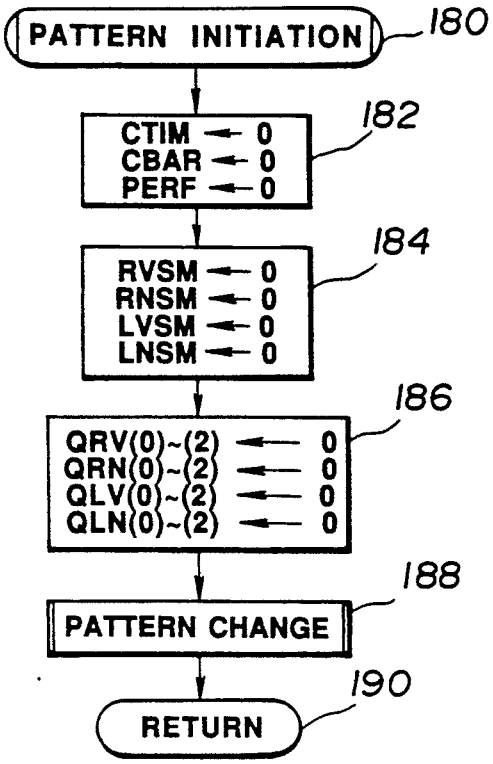
FIG. 11 is a detailed flowchart of a pattern initiation routine of FIG. 10.

As mentioned earlier, in response to the operation of the start switch **24*a*, the CPU 53 carries out the pattern initiation routine shown in step 168 of FIG. 10. As more specifically shown in FIG. 11, this pattern initiation routine is started in step 180, and each of current timing CTIM, current bar CBAR and frame flag PERF is set to an initialization value of "0" in step 182. The frame flag PERF increases by 1 at each bar after the start of an automatic accompaniment action to indicate a current position of the accompaniment. After step 182, each of key touches RVSM, LVSM and depressed key numbers RNSM, LNSM for the left and right keyboards 11, 12 is set to an initialization value of "0" in step 184, and each of frame key touch amounts QRV (0) to QRV (2) and QLV (0) to QLV (2) is set to an initialization value of "0" in step 186. The frame key touch amounts QRV (0) to QRV (2) represent totals of key touch amounts RVSM, LVSM of the past three frames for each bar for the left and right keyboards 11, 12. Next, a "pattern change routine" is carried out in step 188, and the pattern initiation routine is brought to an end in step 190**.

Figure 12:
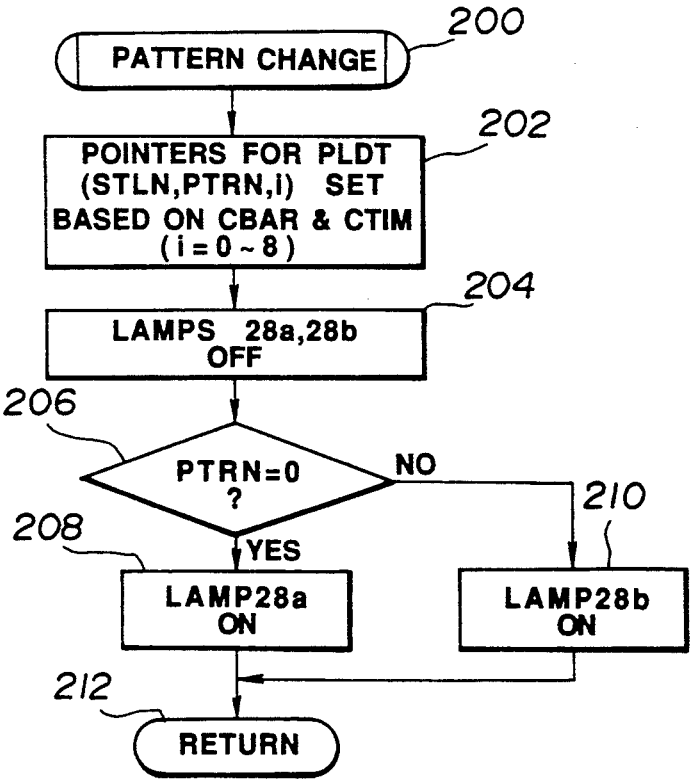
FIG. 12 is a detailed flowchart of a pattern change routine of FIGS. 11 and 23.

As specifically shown in FIG. 12, the pattern change routine comprises steps 200 to 212. In step 202, nine pointers are newly set, through a process similar to that of step 158 in FIG. 10, for addressing the performance data storage areas PLDT (STLN, PTRN, 0) to PLDT (STLN, PTRN, 8). Next, in steps 204 to 210, the CPU 53 controls the lighting of the lamp 28*a* if the pattern number PTRN is "0", but it controls the lighting of the lamp 28*b* if the pattern number PTRN is "1", and then this pattern change routine is brought to an end. In this manner, the lamps 28*a*, 28*b* are lit in accordance with a then established pattern number PTRN (which is "0" at the initial stage and is then changed to "1" or rechanged to "0").

Figure 13:
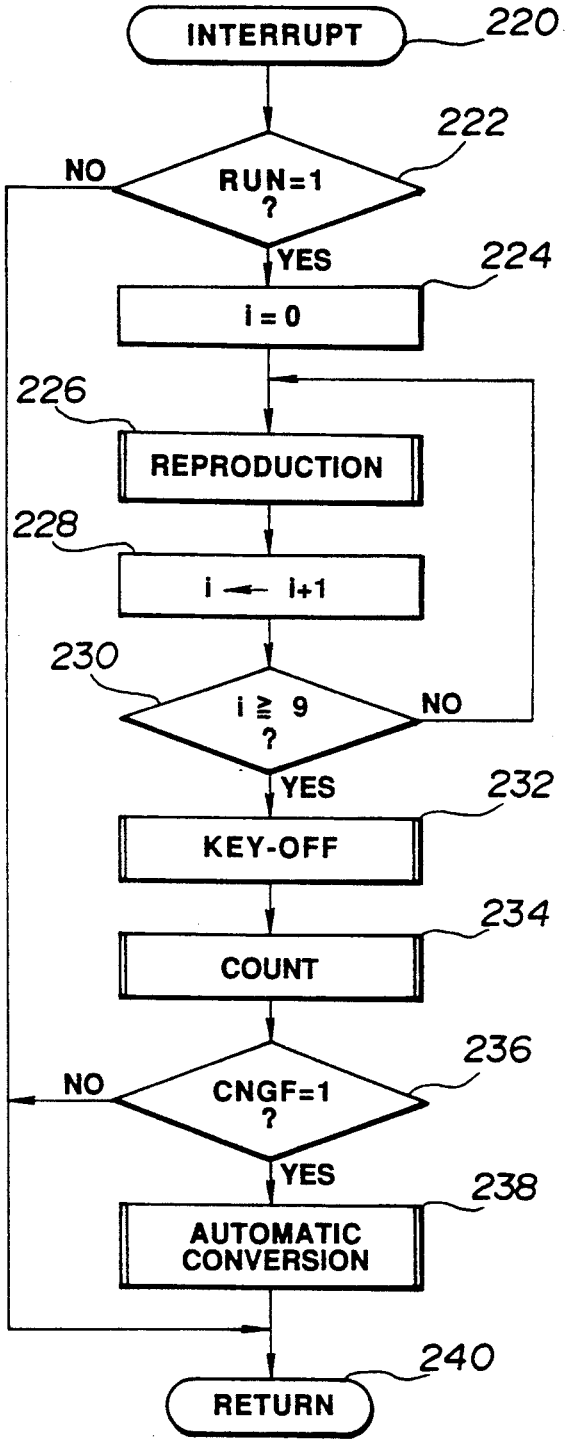
FIG. 13 is a flowchart of an interrupt program carried out by the microcomputer section of FIG. 1.

Then, in response to each tempo clock signal outputted from the tempo clock generator 52 at the frequency corresponding to 1/24 of a quarter tone, the CPU 53 interrupts the main program shown in FIG. 8 so as to start carrying out an "interrupt program" in step 220 of FIG. 13. In next step 222, the CPU 53 makes a "YES" determination on the basis of the run flag RUN that is set at "1" at that time and then carries out processes in steps 224 to 240. However, an "automatic conversion routine" in step 238 is omitted since the the change selection flag CNGF is set at "0" at that time.

Figure 14:
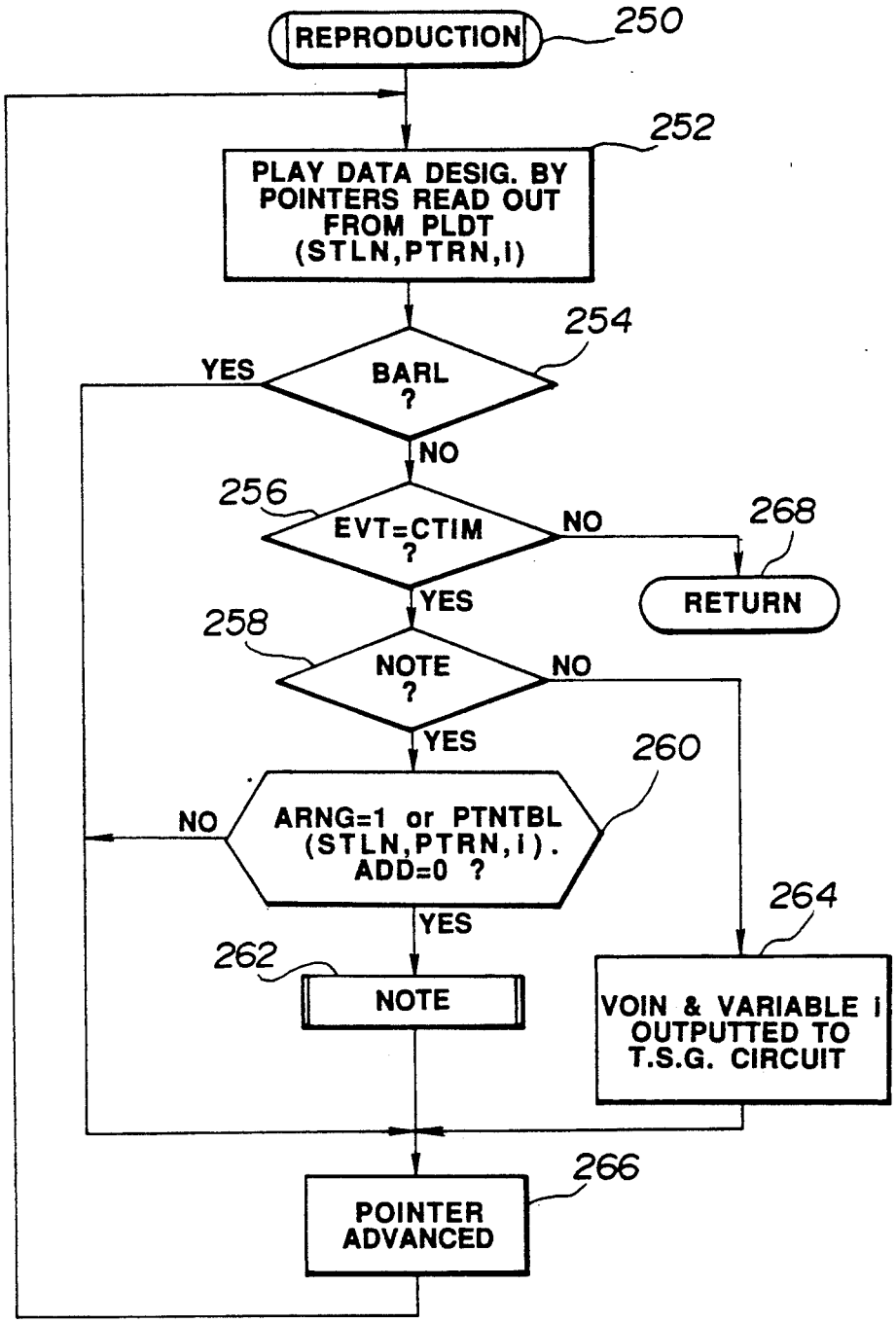
FIG. 14 is a detailed flowchart of a reproduction routine of FIG. 13.

In step 226, the CPU 53 performs a "reproduction routine" in a repeated manner, while incrementing a variable i one by one from "0" to "8" through processes in steps 224, 228 and 230. As shown in FIG. 14, this reproduction routine is started in step 250. Then, in step 252, a set of performance data indicated by the pointers for the respective tracks is sequentially read out from the storage areas PLDT (STLN, PTRN, i) designated by the variable i indicative of a style number STLN, pattern number PTRN and respective track, so that processes in step 254 and other steps subsequent thereto are implemented.

In this case, if the above-mentioned set of performance data read out is bar line data BARL, a "YES" determination is made in step 254, so that the pointer for that track is incremented in step 266, and the program is returned to step 252 for reading out next data for the same track. If the set of performance data read out is note data NOTE whose event time EVT is equal to the current timing CTIM, then "NO", "YES" and "YES" determinations are made in steps 254, 256 and 258, respectively, so that a determination process of step 262 and a "note routine" of step 262 are implemented for controlling generation of a tone. Alternatively, if the set of performance data read out is tone color data TC whose event time EVT is equal to the current timing CTIM, then "NO", "YES" and "NO" determinations are made in steps 254, 256 and 258, respectively, so that generation of a tone is controlled in step 264. Also after these steps 262, 264, the pointer for that track is incremented in step 266, and the program is returned to step 252 for reading out next data for the same track. Further, if the set of performance data read out is note data NOTE or tone color data TC whose event time EVT is not equal to the current timing CTIM, then "NO" determination is made in steps 254, 256, so that the reproduction routine is brought to an end in step 268. In this manner, note data NOTE and tone color data TC are sequentially read out in accordance with the designation of the pointer, and generation of a tone and a tone color of a generated tone are controlled whenever their event times EVT become equal to the current timing CTIM.

Now, detailed description will be made on the above-mentioned control of a tone generation and the tone color of a generated tone.

To first describe the control of the tone color, during the above-mentioned process of step 264, the tone color number VOIN and variable i in the tone color data TC are outputted to the tone signal generating circuit 40. Thus, the tone signal generating circuit 40 sets the tone color of an accompaniment tone for a track designated by the variable i to a tone color designated by the tone color number VOIN.

Figure 15:
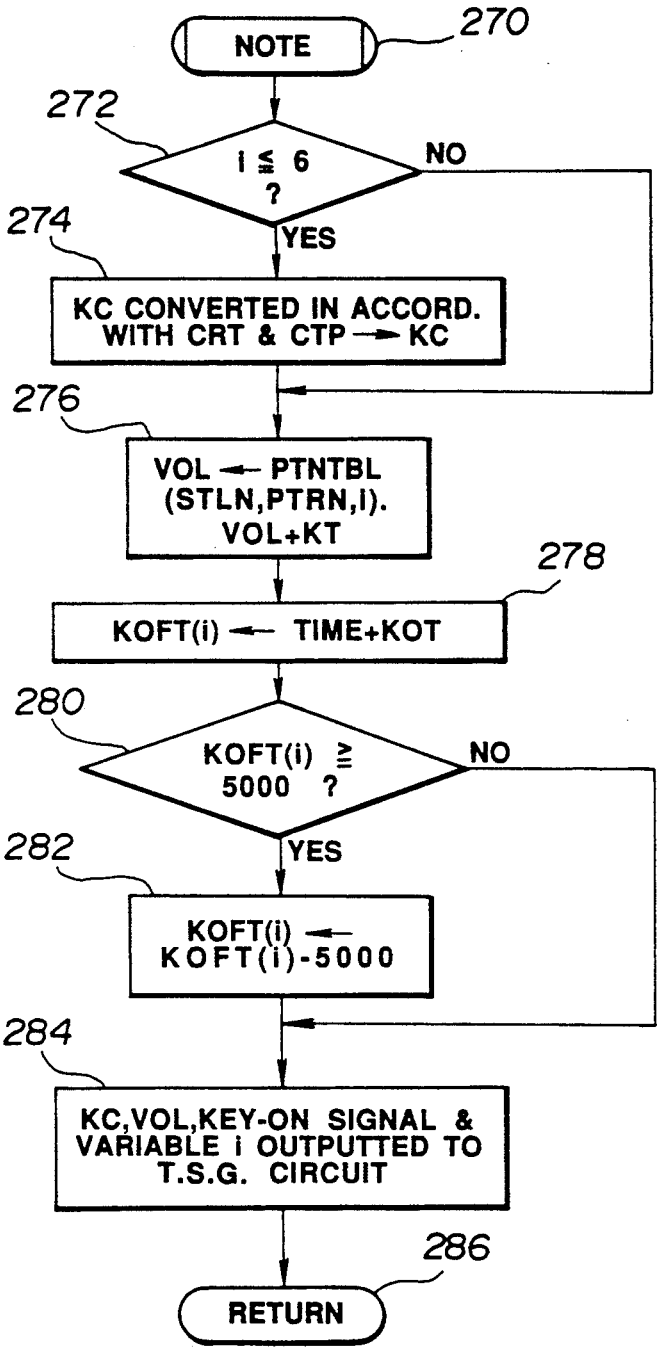
FIG. 15 is a detailed flowchart of a note routine of FIG. 14.
Figure 16:
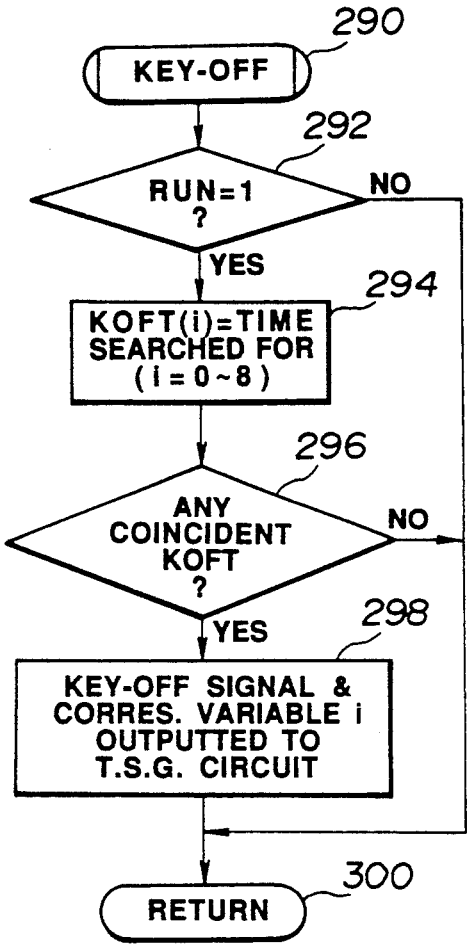
FIG. 16 is a detailed routine of a key-off routine of FIG. 13.

To next describe the control of tone generation, only in the case where the determination result in step 260 shows that the arrange-flag ARNG is "1", or that the additional tone generation flag PTNTBL (STLN, PTRN, i). ADD within the pattern table PTNTBL as designated by the variable i representative of a style number PTRN, pattern number PTRN and track is "0", a note routine of step 262 is carried out to control generation of the accompaniment tone. As shown in FIG. 15, this note routine includes steps 270 to 286. If the variable i is equal to or less than "6", a "YES" determination is made in step 272, so that in step 274, the key code KC constituting the readout note data NOTE is converted, based on the detected chord root CRT as well as the chord type CTP, into a key code KC indicative of a chord component tone or bass tone that corresponds to a chord played on the left keyboard 11. On the other hand, if the variable is equal to or greater than "7", a "NO" determination is made in step 272, so that no conversion process of step 274 is effected. This is because the variable i indicates by the values of 0 to 6 those tracks for the rows of chord component and bass tones and indicates by the values of 7 and 8 those tracks for the row of percussive tones, as previously mentioned in conjunction with FIG. 4. In subsequent steps 276 and 278, a tone volume VOL and a key-off time KOFT (i) are obtained by executing an arithmetic operation of the following formula (1) based on the key-on time KOT and key touch KT included in the read-out note data NOTE see FIG. 5(B):

Formula (1)

$$VOL = PTNTBL(STLN, PTRN, i).\ VOL + KT$$

$$KOFT(i) = TIME + KOT$$

where time TIME represents an absolute lapse of time that is counted upwardly from 0 to 5,000 in a "count routine" to be described later, and key-off time KOFT(i) defines a timing for terminating a generated tone on the basis of the absolute lapse of time. After step 278, steps 280 and 282 are executed such that when the key-off time KOFT(i) has become greater in value than 5,000, 5,000 is deducted from the value of the key-off time KOFT(i), which is thus changed to be smaller than 5,000.

Next in step 284, the converted key code KC (or non-converted key code KC if the variable i is 7 or 8), volume VOL, key-on signal KON and variable i are provided to the tone signal generating circuit 40, which in turn generates an accompaniment tone signal for the track designated by the variable i and outputs the generated tone signal to the speaker 42 via the amplifier 41. In such a case, the accompaniment tone signal has a pitch designated by the key code KC (if the variable i is 7 or 8, the type of the percussive tone is designated by the key code KC), a tone color set by the tone color number VOIN, and also a volume designated by the tone volume VOL. In this manner, a succession of accompaniment tones comprising chord component tones, bass tones and percussive tones are sounded from the speaker 42.

Now, referring back to the interrupt program shown in FIG. 13, after steps 226 to 230, a "key-off" routine is carried out in step 232, and the count routine is carried out in step 234. As specifically shown in FIG. 6, the key-off routine includes steps 290 to 300, in steps 292 to 296 of which a key-off time KOFT(i) coincident with the time TIME is searched for while changing the variable i from 0 to 8, so that in step 298, the variable i related with the key-off time KOFT(i) searched for and a key-off signal is provided to the tone signal generating circuit 40. In response to this, the tone signal generating circuit 40 stops generating accompaniment tone signal for the track indicated by the variable i, and accordingly, termination is effected of sounding from the speaker 42 of the accompaniment tone that corresponds to the accompaniment tone signal.

Figure 17:
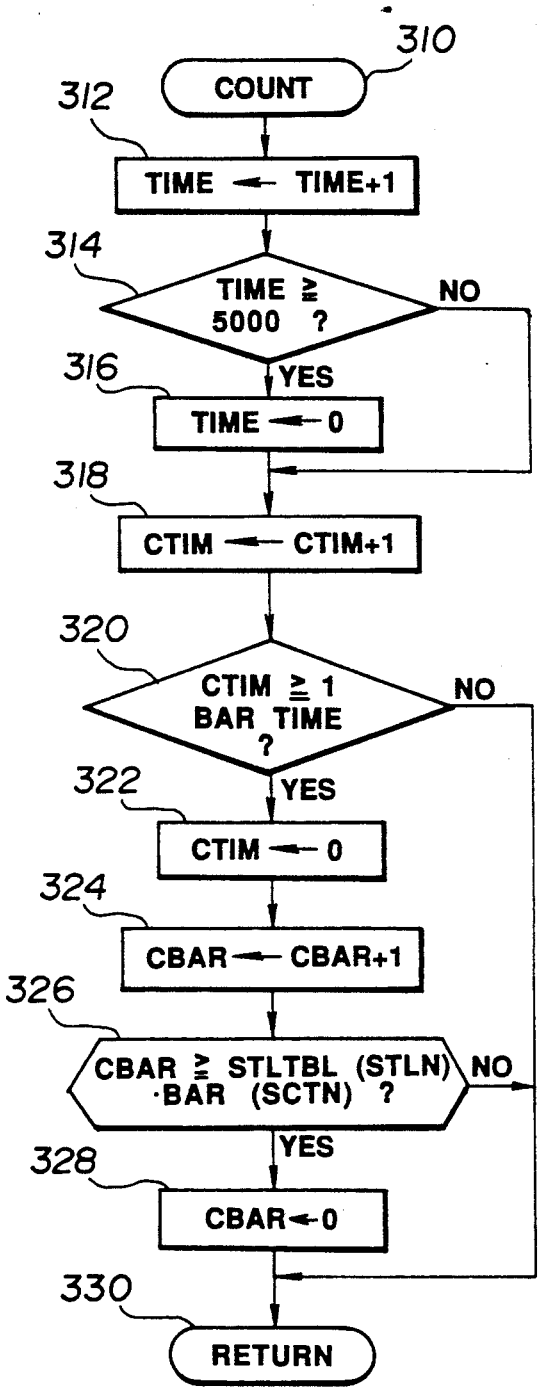
FIG. 17 is a detailed flowchart of a count routine of FIG. 13.

The detail of the count routine is shown in FIG. 17. The count routine starts in step 310, and the time TIME and current timing CTIM are incremented by one by one through the processes in steps 312 and 318, respectively. Also, through the processes in steps 314 and 316, the time TIME is reset to "0" when it has reached a value of 5,000. Further, through the processes in steps 320 and 322, the current timing CTIM is reset to "0" when it has reached one bar timing. Thus, each time the tempo clock generator 52 produces a tempo clock signal, that is, at each timing corresponding to 1/24 of a quarter tone, the time TIME is incremented by one in such a manner that it sequentially reaches from 0 to 4,999 one by one. The value of 4,999 itself has no significant meaning and may be any desired value as long as it is fairly greater than the other time-representative variables. The current timing CTIM is incremented by one at each said timing within each individual bar frame. Further, through the processes in steps 320 and 324 to 328, the current bar CBAR is incremented by one at each bar timing throughout one cycle of a pattern designated by the style number STLN and pattern number PTRN until it reaches from 0 to the bar number (STLTBL(STLN). BAR−1).

As mentioned, an automatic accompaniment operation is initiated in response to the actuation of the start switch 24*a*, and then the interrupt program is implemented each time the tempo clock signal generator 52 produces a tempo clock signal (i.e., at each timing corresponding to 1/24 of a quarter tone). In the interrupt program, the performance data in the accompaniment data memory 60 as designated by the style number STLN and pattern number PTRN is read out in a repeated manner for controlling the generation of an accompaniment tone.

Next, description will be given on operation in the case where the change selection flag is set at "1".

In this case, a "YES" determination is made in step 236 of the interrupt program mentioned in conjunction with FIG. 13, and thus the automatic conversion routine is carried out in the following step 238.

Figure 18:
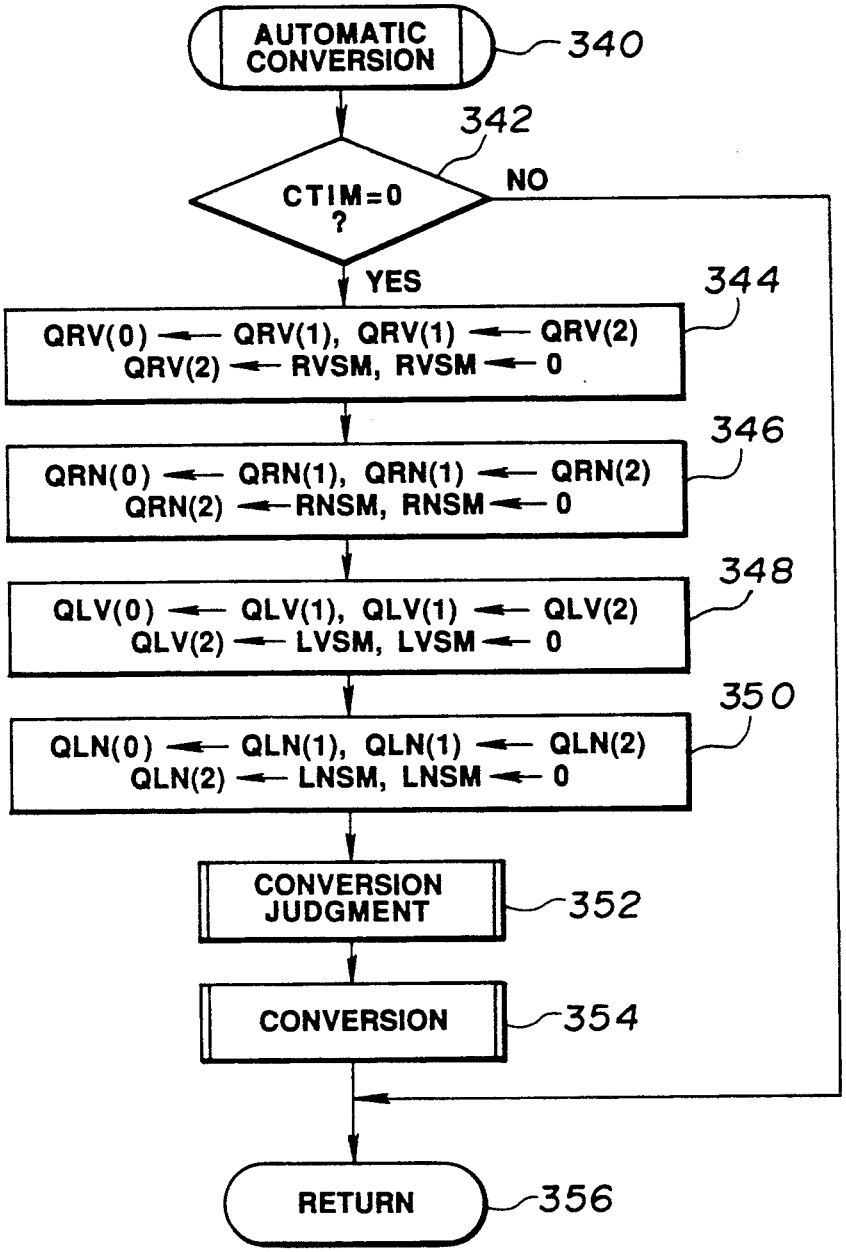
FIG. 18 is a detailed flowchart of an automatic conversion routine of FIG. 13.

As shown in FIG. 18, the automatic conversion routine includes steps 340 to 356. In this routine, only when the current timing CTIM indicates "0" (CTIM=0), that is, for each bar, various processes of steps 344 to 354 are executed as the result of the affirmative determination in steps 342. Then, in step 344, the frame key touch amounts QRV(0), QRV(1), QRV(2) for the right keyboard 12 are respectively renewed to the values of the frame key touch amounts QRV(1), QRV(2) and the key touch amount RVSM for the right keyboard 12 in sequence, and also the key touch amount RVSM is initialized to "0". Next in step 346, the frame depressed key numbers QRN(0), QRN(1), QRN(2) for the right keyboard 12 are respectively renewed to the values of the frame depressed key numbers QRN(1), QRN(2) and the depressed key number RNSM for the right keyboard 12 in sequence, and also the depressed key number RNSM is initialized to "0". Likewise, in step 348, the frame key touch amounts QLV(0), QLV(1), QLV(2) for the left keyboard 11 are respectively renewed to the values of the frame key touch amounts QLV(1), QLV(2) and the key touch amount LVSM for the left keyboard 11 in sequence, and also the key touch amount LVSM is initialized to "0". Next in step 350, the frame depressed key numbers QLN(0), QLN(1), QLN(2) for the left keyboard 11 are respectively renewed to the values of the frame depressed key numbers QLN(1), QLN(2), and the depressed key number LNSM for the left keyboard 11 in sequence, and also the depressed key number LNSM is initialized to "0". Consequently, the frame key touch amounts QRV(0) to QRV(2) and QLV(0) to QLV(2) and frame depressed key numbers QRN(0) to QRN(2) and QLN(0) to QLN(2) on the left and right keyboards 11, 12 are calculated for each of the previous three frames.

Subsequently, a "conversion judgment routine" is carried out in step 352. As specifically shown in FIG. 19, this conversion determination routine includes steps 360 to 380. An up/down index UD is initialized to "0" in step 362, and then it is determined whether or not the frame flag PERF indicates a value which is equal to or greater than "2". As long as the value of the frame flag PERF is smaller than "2", a determination result of "NO" is obtained in step 364, and merely "1" is added to the flag PERF in next step 366 without processes of step 368 and other steps subsequent thereto being executed. This is because the frame flag PERF is initialize to "0" at the outset of the automatic accompaniment action, and the frame key touch amounts and frame depressed key numbers for the previous three frames to be used for evaluating a pattern change have not yet been calculated before the flag PERF indicates a value of "2". When three frames have passed, the flag PERF indicates "2", and then in this conversion judgment routine, processes of steps 368 to 378 are executed as the result of a "yes" determination in step 364.

Those processes of steps 368 to 378 are intended for calculating an up/down index UD in accordance with the performance states of the left and right keyboards 11, 12. If the value of the determination keyboard area flag RNG is "1" which represents that the accompaniment pattern is to be changed only in accordance with the right keyboard 12, then the processes of steps 370 to 374 alone are executed as the result of a "NO" determination in step 368 and a "YES" determination in step 376.

Figure 20:
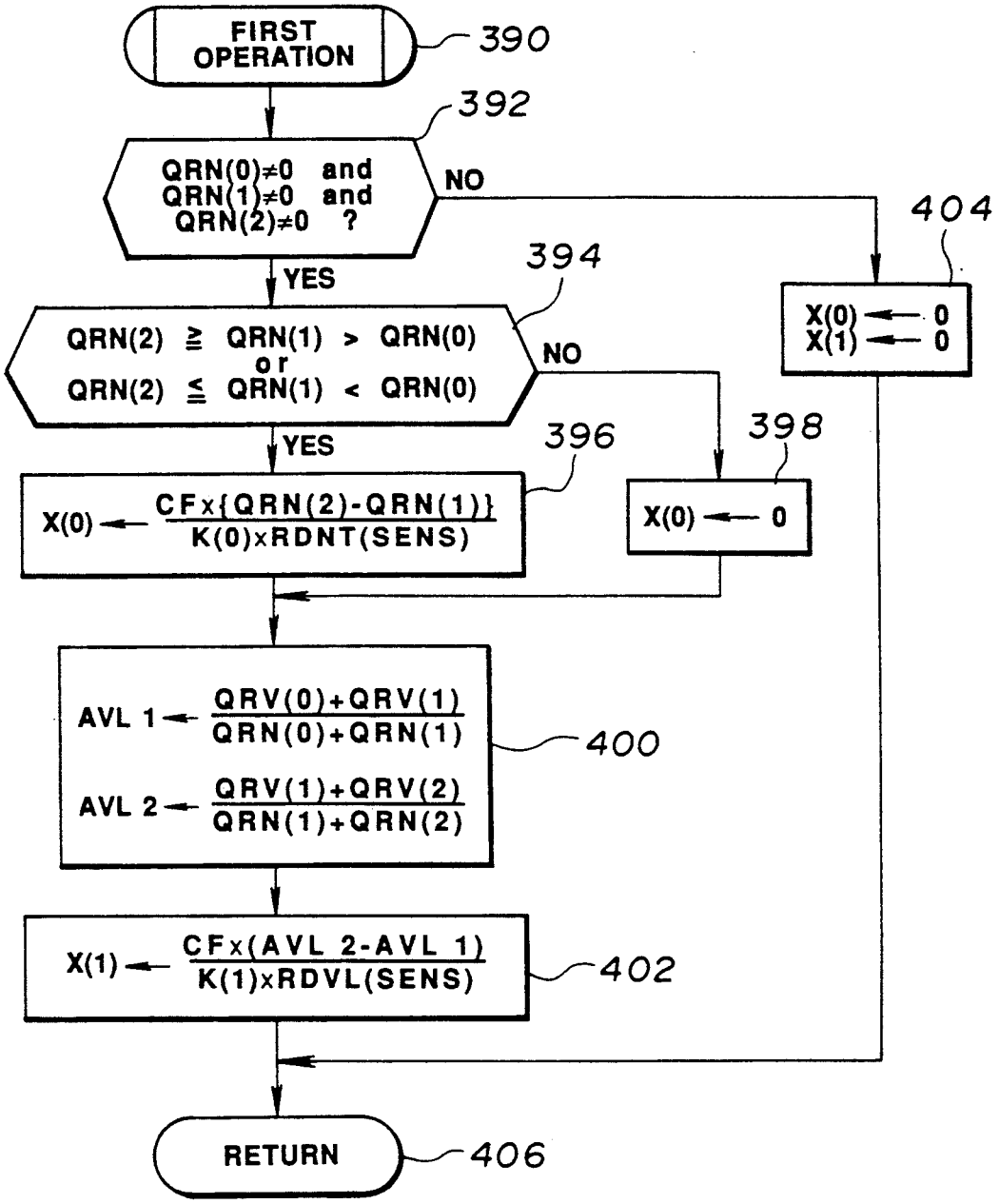
FIG. 20 is a detailed flowchart of a first operation routine of FIG. 19.

In step 370, a "first operation routine" is carried out as shown in FIG. 20. This first operation routine is initiated in step 390, and then a "YES" determination is made in step 392 if none of the individual depressed key numbers QRN(0) to QRN(2) in the previous three frames of the right keyboard 12 is "0", that is, if there has been any depressed key in each of the previous three frames. Then, an index X(0) based on the difference of the depressed key numbers between two successive frames is calculated in steps 394 to 398, and also an index X(1) based on the difference of the average key touch amounts between two successive frames is calculated in steps 400 and 402. If, on the other hand, any of the individual depressed key numbers QRN(0)-QRN(2) in the previous three frames of the right keyboard 12 is "0", that is, if there has not been any depressed key in any of the previous three frames, a "NO" determination is made in step 392, as the result of which both of the indices X(0), X(1) are set to "0".

The above-mentioned index X(0) is calculated in accordance with the following formula (3), in the event that either of logical operations based on the following formula (2) is satisfied and hence a "YES" determination is made in step 394. If neither of logical operations based on the formula (2) is satisfied and hence a "NO" determination is made in step 394, the index X(0) is set to "0".

Formula (2)

$$QRN(2) \geqq QRN(1) > QRN(0)$$

$$QRN(2) \leqq QRN(1) < QRN(0)$$

Formula (3)

$$X(0) = CF \times \{QRN(2) - QRN(1)\} / \{K(0) \times RDNT(SENS)\}$$

In the case where the operation results show that the depressed key numbers QRN(0), QRN(1), QRN(2) over the past three frames sequentially increase, the index X(0) takes a positive value indicative of the difference of the depressed key numbers QRN(0), QRN(1) between the last and second-to-last frames. Alternatively, in the case where the operation results show that the depressed key numbers QRN(0), QRN(1), QRN(2) over the previous three frames sequentially decrease, the index X(0) takes a negative value indicative of the difference of the depressed key numbers QRN(0), QRN(1) between the last and second-to-last frames. In these cases, since an arrangement is made such that the change evaluation coefficient CF is set to "0.5" if the accompaniment pattern has been changed in the last frame and is set to "1" if the accompaniment pattern has not been changed in the last frame, the absolute value of the index X(0) becomes small if the accompaniment pattern has been changed in the last frame. In addition, since an arrangement is also made such that the tone color coefficient K(0) is set to "0.8" if the tone color of a melody tone is that of the strings (see part (B) of FIG. 6) and is set to "1" if the tone color of a melody tone is other than that of the strings, the absolute value of the index X(0) becomes great.

Further, in the case where the depressed key numbers QRN(0), QRN(1), QRN(2) of the previous three frames do not sequentially increase or decrease, the index X(0) is set to "0".

The index X(1) is calculated in steps 400 and 402 in accordance with the following formula (4):

Formula (4)

$$AVL1 = \{QRV(0) + QRV(1)\} / \{QRN(0) + QRN(1)\}$$

$$AVL2 = \{QRV(1) + QRV(2)\} / \{QRN(1) + QRN(2)\}$$

$$X(1) = CF \times (AVL2 - AVL1) / \{(K(1) \times RDVL(SENS)\}$$

In the case where the operation results show that the frame key touch amounts QRV(0), QRV(1), QRV(2) have an increasing trend, the index X(1) takes a positive value indicative of the difference between the average key touch amount AVL1 over the last and second-to-last frames, and the average key touch amount AVL2 over the second-to-last and third-to-last frames. Alternatively, in the case where the operation results show that the frame key touch amounts QRV(0), QRV(1), QRV(2) have a decreasing trend, the index X(1) takes a negative value indicative of the difference between both of the average key touch amounts AVL1, AVL2. Also in such cases, the change evaluation coefficient CF and tone color coefficient K(1) have the same effect on the absolute value of the index X(1) as mentioned earlier.

Figure 19:
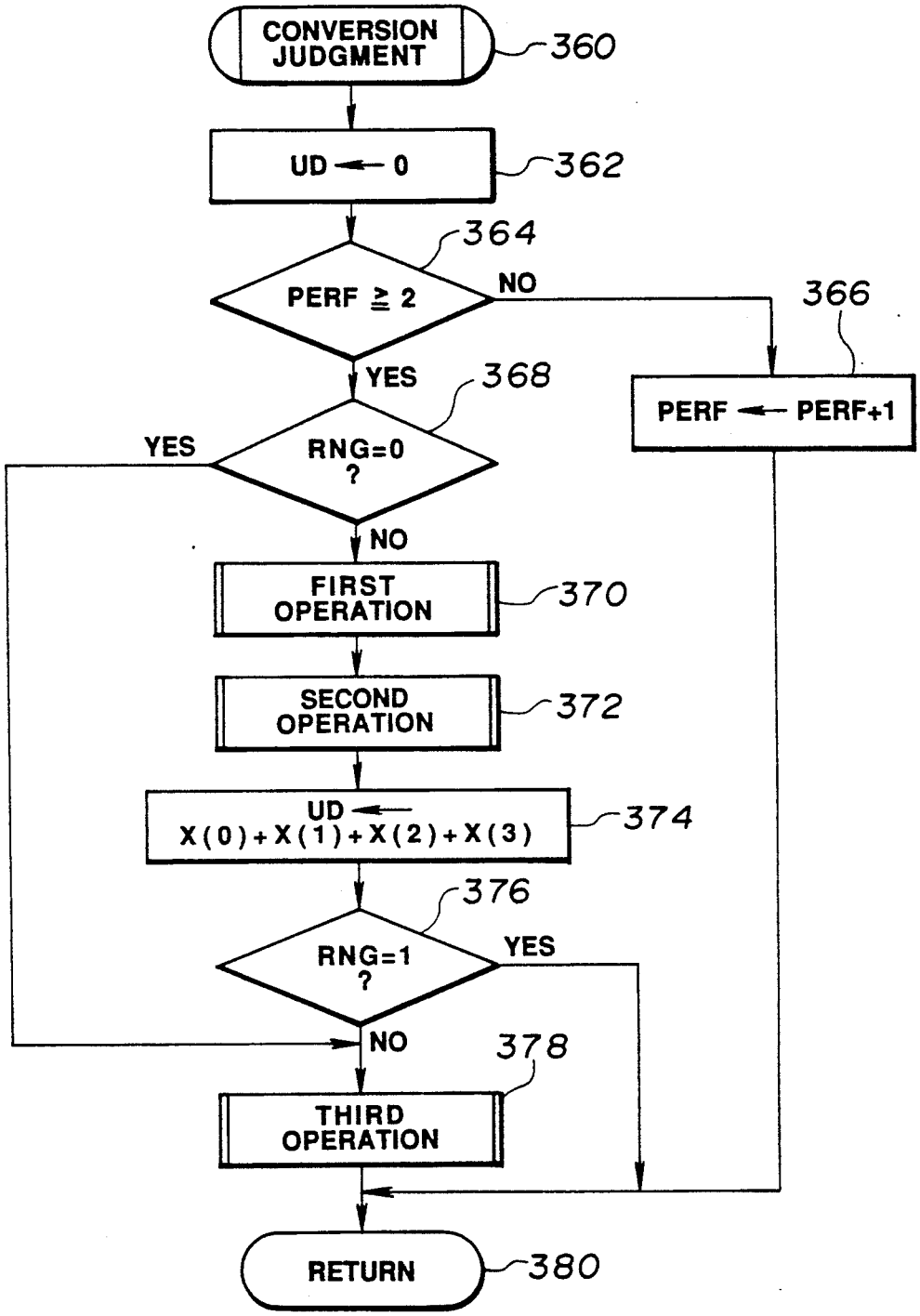
FIG. 19 is a detailed flowchart of a conversion judgment routine of FIG. 18.
Figure 21:
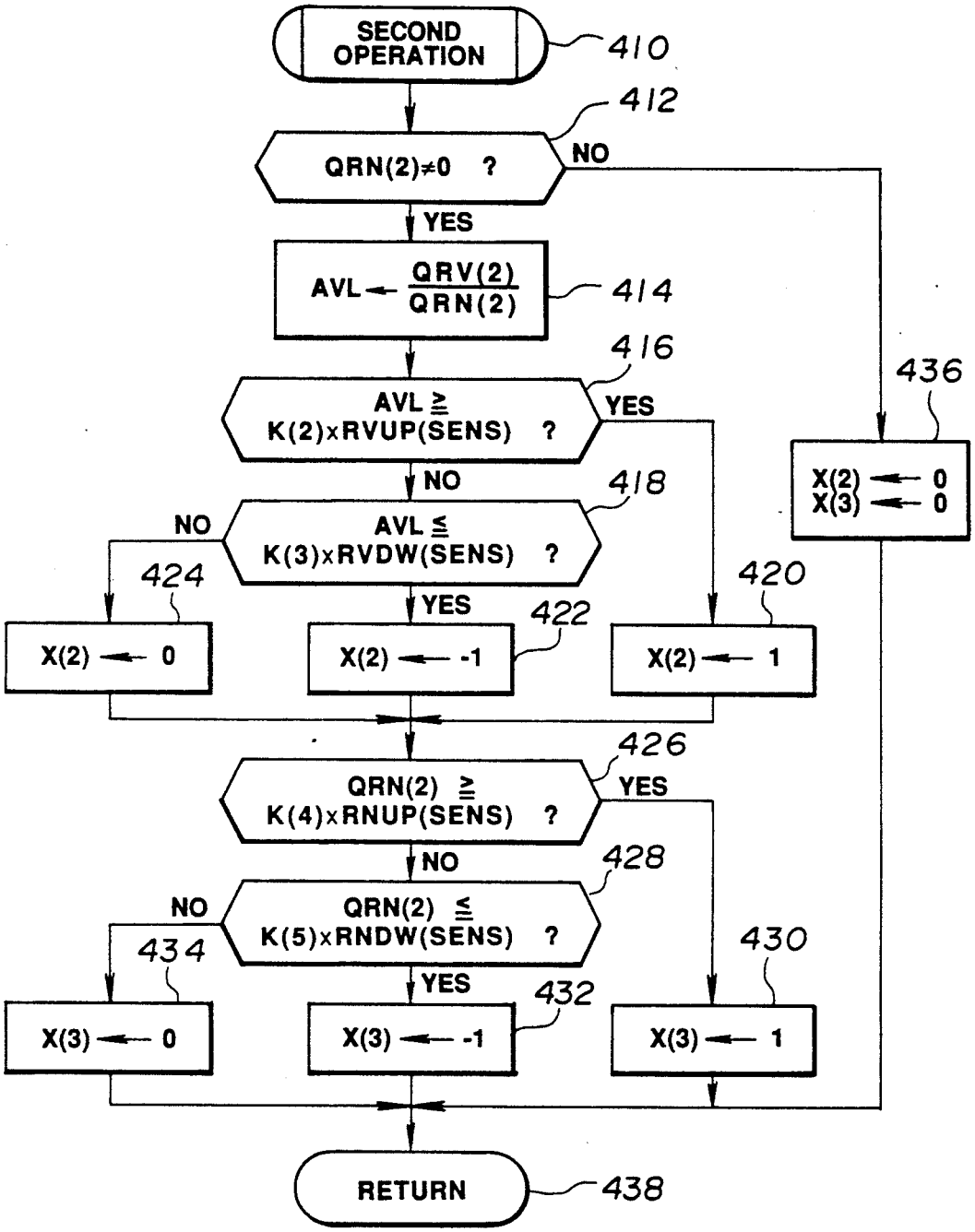
FIG. 21 is a detailed flowchart of a second operation of FIG. 19.

In step 372 of FIG. 19, a "second operation routine" is carried out as shown in FIG. 21. This second operation routine is initiated in step 410, and a "YES" determination results in step 412 if the depressed key number of the last frame for the right keyboard 12 is not "0", that is, if there has been a depressed key on the right keyboard 12 in the last frame, an index X(2) is calculated in steps 414 to 424 based on the average key touch amount AVL of the last frame, and an index X(3) is calculated in steps 426 to 434 based on the average depressed key number QRN(2) of the last frame. Alternatively, if the depressed key number of the last frame for the right keyboard 12 is "0", that is, if there has not been a depressed key on the right keyboard 12 in the last frame, a "NO" determination results in step 412, as the result of which both of the indices X(2), X(3) are set to "0".

In the above-mentioned operation to obtain the index X(2), the average key touch amount AVL is calculated in step 414. If the average key touch amount AVL calculated is equal to or greater than a value which is obtained by multiplying the reference value RVUP(SENS) read out from the change condition table CGCTBL (part (A) of FIG. 6) by the tone color coefficient K(2), namely, if AVL≧K(2)×RVUP(SENS), a "YES" determination results in step 416, so that the index X(2) is set to "1" in step 420. If the average key touch amount AVL calculated is equal to or smaller than a value which is obtained by multiplying the reference value RVDW(SENS) read out from the change condition table CGCTBL by the tone color coefficient K(3), namely, if AVL≦K(3)×RVDW(SENS), a "YES" determination results in step 418, so that the index X(2) is set to "−1" in step 422. Further, if the average key touch amount AVL is between the values of K(2)×RVUP(SENS) and K(3)×RVDW(SENS), a "NO" determination results in both steps 416 and 418, so that the index X(2) is set to "0" in step 424.

In this case, the tone color coefficients K(2), k(3) are set to "0.8" and "1.2", respectively, if the tone color of the melody tone is that of the strings (see part (B) of FIG. 6), but they are set to "1" if the tone color of the melody tone is other than that of the strings. Thus, in the event that the tone color of the melody tone is that of the strings, the index X(2) can easily take a positive value (=1) or negative value (=−1) even if the variation of the average key touch amount AVL is scarce.

In the above-mentioned operation to obtain the index X(3). If the depressed key number QRN(2) is equal to or greater than a value which is obtained by multiplying the reference value RNUP(SENS) read out from the change condition table CGCTBL (part (A) of FIG. 6) by the tone color coefficient K(4), namely, if QRN(2)≧K(4)×RNUP(SENS), a "YES" determination results in step 426, so that the index X(3) is set to "1" in step 430. If the depressed key number QRN(2) is equal to or smaller than a value which is obtained by multiplying the reference value RNDW(SENS) read out from the change condition table CGCTBL by the tone color coefficient K(5), namely, if QRN(2)≦K(5)×RNDW(SENS), a "YES" determination results in step 428, so that the index X(4) is set to "−1" in step 432. Further, if the depressed key number QRN(2) is between the values of K(4)×RNUP(SENS) and K(5)×RNDW(SENS), a "NO" determination results in both steps 426 and 428, so that the index X(3) is set to "0" in step 434.

Also in this case, the index X(3) is affected in the same manner as in the above-mentioned cases, and in the event that the tone color of the melody tone is that of the strings, the index X(3) can easily take a positive value (=1) or negative value (=−1) even if the variation of the depressed key number QRN(2) is scarce.

After the first and second operation routines of steps 370 and 372 shown in FIG. 19, the calculated indices X(0)–X(3) are added together to be established as an up/down index in step 374, and as the result of a "NO" determination in step 376, the conversion judgment routine is terminated in step 380. Subsequently, the flow returns to the automatic conversion routine shown in FIG. 18 so as to carry out a "conversion routine" in step 354 thereof.

Figure 23:
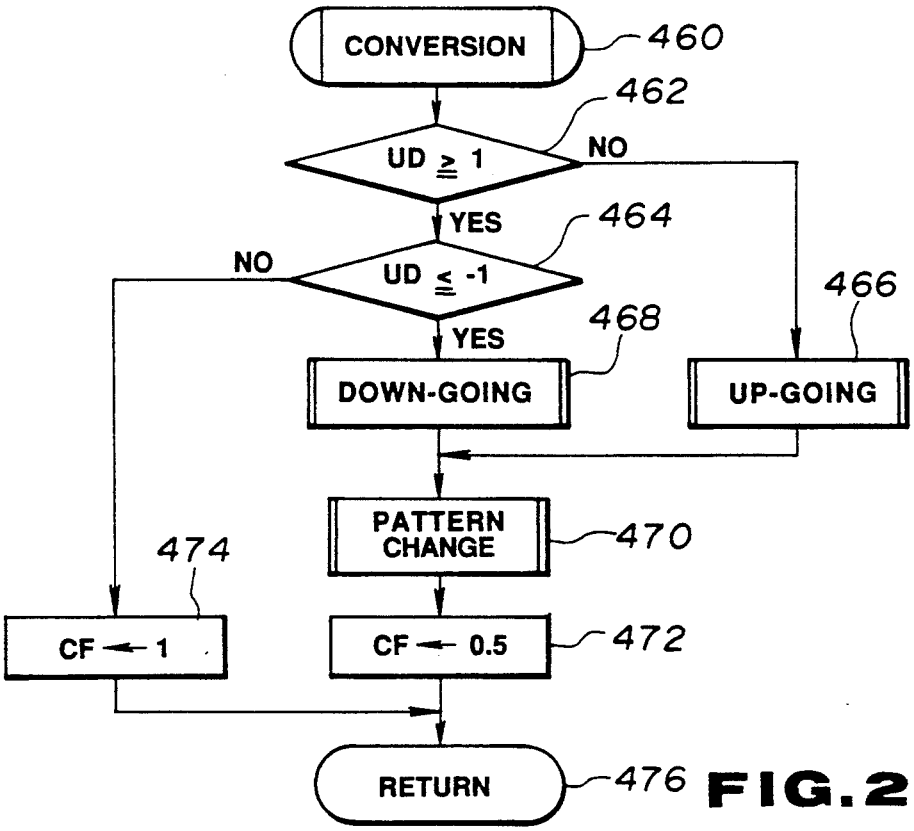
FIG. 23 is a detailed flowchart of a conversion routine of FIG. 18.

As more specifically shown in FIG. 23, this conversion routine comprises steps 460 to 476, in steps 462 and 464 of which the up/down index UD is examined. If the up/down index UD is equal to or greater than "1", a "YES" determination results in step 464, so that an "up-going routine" is carried out in step 466 based on the evaluation that the keyboard performance state is in the up-going state. If, on the other hand, the up/down index UD is equal to or smaller than "−1", a "YES" determination results in step 464, so that an "down-going routine" is carried out in step 468 based on the evaluation that the keyboard performance state is in the down-going state.

If the up/down index UD indicates a value between "−1" and "1", a "NO" determination results in both steps 462 and 464, so that the change evaluation coefficient CF is merely set in step 474 to "1" which indicates that no automatic pattern change is under way, with neither of the above-mentioned up-going and down-going routines being carried out based on the evaluation that the keyboard performance state is not changing.

Figure 24:
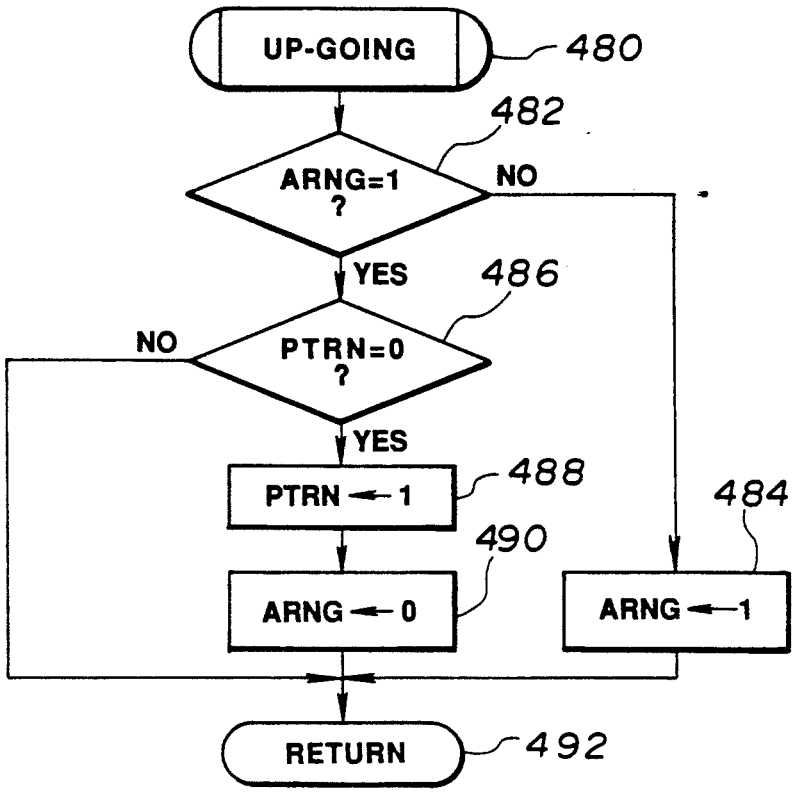
FIG. 24 is a detailed flowchart of an up-going routine of FIG. 23.

In the up-going routine which comprises steps 480 to 492 as shown in FIG. 24, if the arrange-flag ARNG currently indicates a value of "0", determination is made as "NO" in step 482 so that the value of the flag ARNG is changed to "1" in step 484. If, on the other hand, the arrange-flag ARNG currently indicates a value of "1", determination is made as "YES" in step 482. After such determination, a "YES" determination results in step 486 only when the current pattern number PTRN is "0", the pattern number PTRN is changed to "1" in step 488, and then the arrange-flag ARNG is also changed to "0" in step 490.

After the up-going routine, the program advances to a "pattern change routine" of step 470 in FIG. 23, in which the automatic accompaniment pattern change is effected in accordance with the changed pattern number PTRN. Following step 470, the change evaluation coefficient CF is set in step 472 to "0.5" indicating that the automatic pattern change has been done.

Consequently, if the automatic accompaniment pattern being currently played is the normal mode (ARNG=0) of the first or second accompaniment pattern (PTRN=0 or 1) in the case where the up/down index UD is equal to or greater than "1", then the automatic accompaniment pattern is changed to the arrange-mode (ARNG=1) of the first or second accompaniment pattern. If, on the other hand, the automatic accompaniment pattern being currently played is the arrange-mode (ARNG=1) of the first accompaniment pattern (PTRN=0), then the automatic accompaniment pattern is changed to the normal mode (ARNG=0) of the second accompaniment pattern (PTRN=1).

Figure 25:
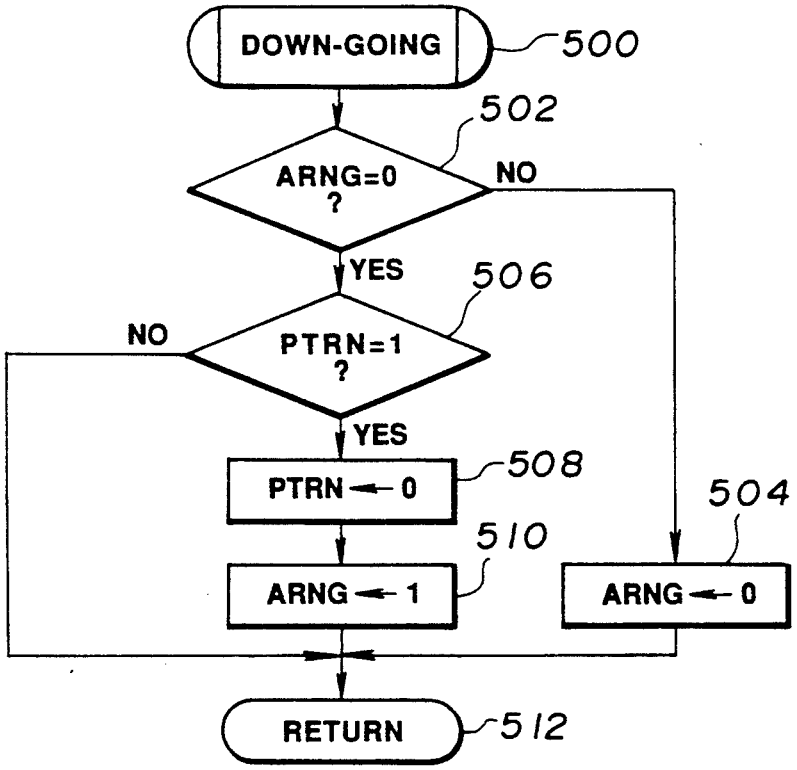
FIG. 25 is a detailed flowchart of a down-going routine of FIG. 23.

In the down-going routine which comprises steps 500 to 512 as shown in FIG. 25, if the arrange-flag ARNG currently indicates a value of "1", determination is made as "NO" in step 502 so that the value of the flag ARNG is changed to "0" in step 504. If, on the other hand, the arrange-flag ARNG currently indicates a value of "0", determination is made as "YES" in step 502. After such determination, a "YES" determination results in step 506 only when the current pattern number PTRN is "1", the pattern number PTRN is changed to "0" in step 508, and then the arrange-flag ARNG is also changed to "1" in step 510.

After the down-going routine, the program advances to a "pattern change routine" of step 470 in FIG. 23, in which the automatic accompaniment pattern change is effected in accordance with the changed pattern number PTRN. Following the process of step 470, the change evaluation coefficient CF is set in step 472 to "0.5" indicating that the automatic pattern change has been done.

Consequently, if the automatic accompaniment pattern being currently played is the arrange-mode (ARNG=1) of the first or second accompaniment pattern (PTRN=0 or 1) in the case where the up/down index UD is equal to or greater than "−1", then the automatic accompaniment pattern is changed to the normal mode (ARNG=0) of the first or second accompaniment pattern. If, on the other hand, the automatic accompaniment pattern being currently played is the normal mode (ARNG=0) of the second accompaniment pattern (PTRN=1), then the automatic accompaniment pattern is changed to the arrange-mode (ARNG=1) of the first accompaniment pattern (PTRN=0).

As can be understood from the foregoing description, as long as the determination keyboard area flag RNG shows "1" which indicates that an accompaniment pattern is to be changed in accordance only with the performance state of the right keyboard 12, the automatic accompaniment pattern is automatically changed in accordance with the performance state of the right keyboard 12, that is, in accordance with the differences of the depressed key numbers QRN(0) to QRN(2) and of the average key touch amounts AVL1 and AVL2 on the right keyboard 12 over a plurality of successive frames. Also, the automatic accompaniment pattern is changed in accordance with the average key touch amount AVL and depressed key number QRN(2) in a predetermined frame. Further, in this case, the reference values RDNT(SENS), RDVL(SENS), RVUP(SENS), RVDW(SENS), RNUP(SENS), RNDW(SENS) are changed among three values, and this allows the player to select suitable pattern change conditions in view of his inclination, or the mood of a music piece.

Further, since in the above-mentioned change evaluation, consideration is given to the tone color coefficient K(i) (table tone color coefficient TK(i)) which is established at different values depending on whether or not the tone color of a melody tone is that of the strings, and also to the change evaluation coefficient CF which is established at different values depending on the presence or absence of a change in the last accompaniment pattern, the automatic change conditions for the accompaniment pattern change can be modified in accordance with the tone color of a melody tone and the previous pattern change state.

Next, description will be made on the case where the determination keyboard area flag RNG is set at "0" which indicates that an accompaniment pattern is to be changed in accordance only with the performance state of the left keyboard 11.

In this case, determination is made as "YES" in step 368 of the above-mentioned conversion judgment routine of FIG. 19, and only a "third operation routine" of step 347 is carried out.

Figure 22:
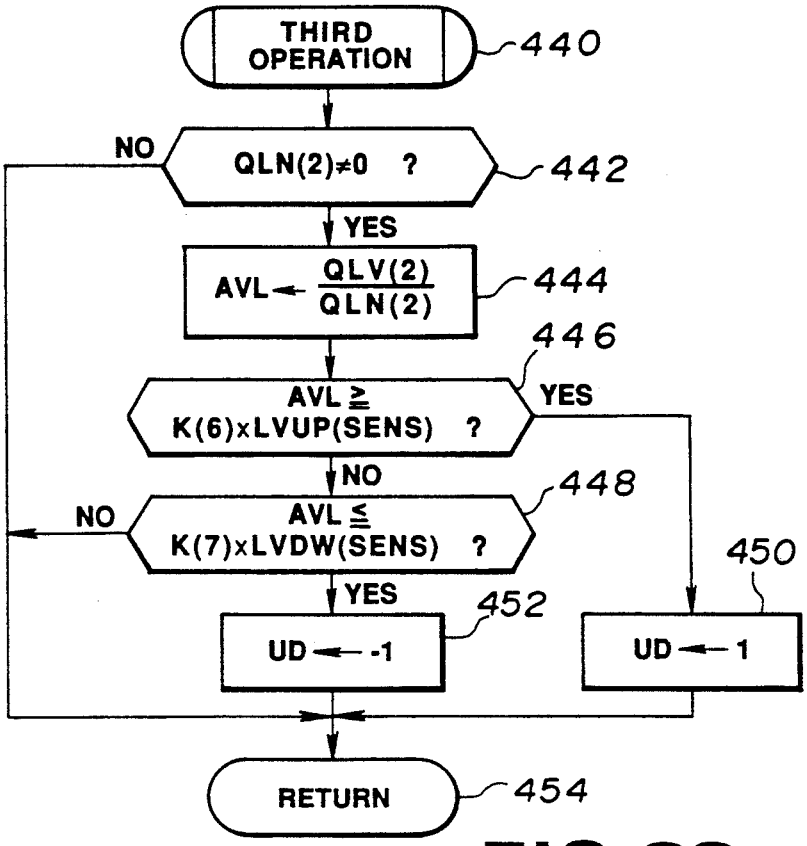
FIG. 22 is a detailed flowchart of a third operation of FIG. 19.

As specifically shown in FIG. 22, this third operation routine is initiated in step 440. Then, if the depressed key number QLN(2) of the last frame for the left keyboard 11 is not "0", in other words, if there has been any depressed key on the left keyboard 11 in the last frame, determination is made as "YES" in step 442, so that steps 444 to 452 are taken for calculating an up/down index UD on the basis of the average key touch amount AVL of the last frame for the left keyboard 11. If, on the other hand, the depressed key number QLN(2) is "0", in other words, if there has been no depressed key on the left keyboard 11 in the last frame, determination is made as "NO" in step 442, so that the implementation of this routine is terminated, and accordingly, the up/down index UD remains at "0" as initially set in step 362 of FIG. 19.

In the above-mentioned operation to obtain the up/down index UD, the average key touch amount AVL in the last frame for the left keyboard 11 is calculated. If the calculated average key touch amount AVL is equal to or greater than a value which is obtained by multiplying the reference value LVUP(SENS) read out from the change condition table CGCTBL (part (A) of FIG. 6) by the tone color coefficient K(6), namely, if AVL≧K(6)×LVUP(SENS), a "YES" determination results in step 446, so that the up/down index UD is set to "1" in step 450. If the average key touch amount AVL is equal to or smaller than a value which is obtained by multiplying the reference value RVDW(SENS) read out from the change condition table CGCTBL by the tone color coefficient K(7), namely, if AVL≦K(7)×LVDW(SENS), a "YES" determination results in step 448, so that the up/down index UD is set to "−1" in step 452. Further, if the average key touch amount AVL is between the two values of K(6)×LVUP(SENS) and K(7)×LVDW(SENS), a "NO" determination results in both steps 446 and 448, so that the index UD is maintained at "0" in the same manner as previously mentioned.

Also in this case, the tone color coefficients K(6), K(7) are set to "0.8" and "1.2", respectively when the tone color of a melody tone is that of the strings (see part (B) of FIG. 6) and are set to "1" when the tone color of a melody tone is other than that of the strings. Thus, in the event that the tone color of the melody tone is that of the strings, the up/down index UP can easily take a positive value (=1) or negative value (=−1) even if the variation of the average key touch amount AVL is scarce.

After the third operation routine (step 378 of FIG. 19, and FIG. 22), the conversion routine is carried out in step 354 of the automatic conversion routine of FIG. 18.

Figure 7:
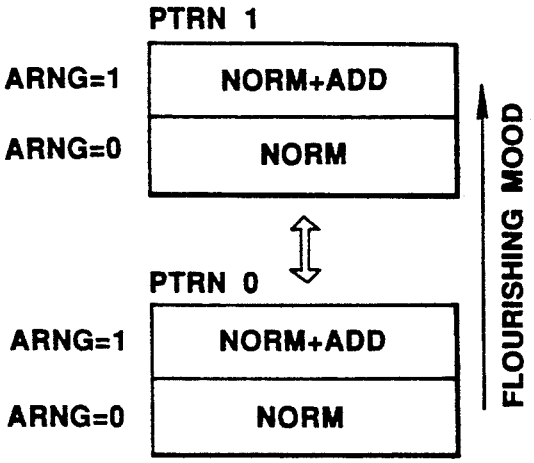
FIG. 7 is a diagram illustrating a manner in which automatic accompaniment patterns are changed.

In this conversion routine, as previously mentioned in connection with FIG. 23, if the up/down index UD is equal to or greater than "1", the up-going routine of FIG. 24 is carried out to direct the automatic accompaniment pattern in the flourishing direction on the basis of the recognition that the performance state of the left keyboard 11 is in the up-going state (see FIG. 7). If, on the other hand, the up/down index UD is equal to or smaller than "−1", the down-going routine is carried out to direct the automatic accompaniment pattern in the subduing direction on the basis of the recognition that the keyboard performance state of the left keyboard 11 is in the down-going state (also see FIG. 7). If the up/down index UD indicates a value between "−1" and "1", neither of the up-going routine or down-going routine is carried out and no change is made of the automatic accompaniment patterns.

As can be understood from the foregoing description, as long as the determination keyboard area flag RNG shows "0" which indicates that an accompaniment pattern is to be changed in accordance only with the performance state of the left keyboard 11, the automatic accompaniment pattern is automatically changed in the course of the automatic accompaniment action in accordance with the performance state of the left keyboard 11, that is, in accordance with the average key touch amount AVL of the left keyboard 11 in a predetermined frame. Further, in this case, the reference values LVUP(SENS), LVDW(SENS) are changed among three values, and this allows the player to select suitable pattern change conditions in view of his inclination or the mood of a music piece.

Further, since in the above-mentioned change evaluation, consideration is given to the tone color coefficient K(i) (table tone color coefficient TK(i)) which is established at different values depending on whether or not the tone color of a melody tone is that of the strings, the automatic change conditions for the accompaniment pattern change can be changed in accordance with the tone color of a melody tone. Also in this case, the tone color coefficients K(6), K(7) are set to "0.8" and "1.2", respectively when the tone color of a melody tone is that of the strings (see part (B) of FIG. 6) and are set to "1" when the tone color of a melody tone is other than that of the strings. Thus, in the event that the tone color of the melody tone is that of the strings, the up/down index UP can easily take a positive value (=1) or negative value (=−1) even if the variation of the average key touch amount AVL is scarce.

Next, description will be made on the case where the determination keyboard area flag RNG is set at "2" which indicates that an accompaniment pattern is to be changed in accordance with the performance states of the left and right keyboard 11, 12.

In this case, determination is made as "NO" in both steps 368 and 376 of the above-mentioned conversion judgment routine of FIG. 19, so the up/down index UD is calculated in accordance with the performance state of the right keyboard 12 through processes of steps 370 to 374, and also the index UD is corrected in accordance with the performance state of the left keyboard 11 through process of step 378. Then, an accompaniment pattern is changed based on the corrected up/-down index UD through the process of the conversion routine shown in FIG. 23, and thus the accompaniment pattern can be changed in accordance with the performance states of the left and right keyboards 11, 12.

In this manner, a keyboard or keyboards to be used for controlling the change of the accompaniment patterns are selected in accordance with the value "0" to "2" indicated by the determination area flag RNG, and the determination area flag RNG is selectively set in response to the operation of the determination area setting switch 27. Accordingly, the player can select a keyboard or keyboards to be used for controlling the change of the accompaniment patterns as desired.

In the foregoing embodiment, it has been described that the differences of depressed key numbers QRN(2), QRN(1) and of average key touches AVL2-AVL1 between two frames, and average key touch amount AVL (QRV(2)/QRN(2)) and depressed key number QRN(2) in a predetermined framed are detected as the performance state data of the right keyboard 12 to be utilized for controlling the change of the accompaniment patterns (see the conversion judgment routine shown in FIG. 19). However, in stead of detecting all the four kinds of data, only one or more them may be detected to be utilized for controlling the accompaniment pattern change.

Further, in the foregoing embodiments, the indices X(2), X(3) have been described as being calculated by adding the average key touch amount AVL (QRV(2)/QRN(2)) and depressed key number QRN(2) only with the reference values RVUP(SENS), RVDW(SENS), RNUP(SENS), RNDW(SENS) (see the second operation routine shown in FIG. 21). However, in a similar manner as in the case of the indices X(0), X(1), the indices X(2), X(3) may be calculated by adding the change evaluation coefficient CF representative of the accompaniment pattern change state of the last frame, with the average key touch amount AVL (QRV(2)/QRN(2)).

Moreover, in the foregoing embodiments, the differences of depressed key numbers QRN(2)-QRN(1) and of average key touches QRN(2)-QRN(1), average key touch amount AVL (QRV(2)/QRN(2) and depressed key number QRN(2) are added with the change evaluation coefficient CF and the reference values RDNT(SENS), RDVL(SENS), RVUP(SENS), RVDW(SENS), RVUP(SENS), RNDW(SENS) in order to obtain the indices X(0) to X(3) and up/down index UD (see the conversion judgment routine shown in FIG. 19, and the first and second operation routines shown in FIGS. 20 and 21), and subsequently, the up/-down index UD is compared with the reference values "1", "−1" to determine whether or not an accompaniment pattern change is implemented (see the conversion routine shown in FIG. 23). However, the reference values "1", "−1" may be modified in accordance with a coefficient corresponding to the tone color of a melody tone, change evaluation coefficient indicative of the accompaniment pattern change state of the last frame and value as selected by the pattern change condition setting switch 26.

Furthermore, although in the foregoing embodiments, only the average key touch amount AVL (QRV(2)/QRN(2)) in a predetermined frame is detected as the performance state data of the left keyboard 11 to be utilized for controlling the change of the accompaniment patterns (see the conversion judgment routine shown in FIG. 19, third operation routine shown in FIG. 22 and conversion routine shown in FIG. 23), the differences of depressed key numbers and of average key touches between two frames, and depressed key number in a predetermined frame may alternatively be detected as the performance state data of the left keyboard 11 to be utilized for controlling the change of the accompaniment patterns.

In the case of the left keyboard 11 as well, the reference values "1", "−1" may be modified in accordance with a coefficient corresponding to the tone color of a melody tone, change evaluation coefficient indicative of the accompaniment pattern change state of the last frame and value as selected by the pattern change condition setting switch 26. Also, both the reference values "1", "−1" with which the detected deferences of depressed key numbers and average key touches, average key touch and depressed key number are compared, and/or the detected values may be modified in accordance with a coefficient corresponding to the tone color of a melody tone, change evaluation coefficient indicative of the accompaniment pattern change state of the last frame and value as selected by the pattern change condition setting switch 26.

In addition, the following data may be detected as the performance state data for the left and right keyboards 11, 12:

(1) performance frequency in a predetermined frame of each chord type such as a major or minor chord which is designated by the left keyboard 11;
(2) number of depression of black-colored or white-colored keys in a predetermined frame, and
(3) average key depression time on the left and right keyboards 11, 12 in a predetermined frame.

Moreover, although in the foregoing embodiments, a frame in which the playing state is detected is one bar, it may be shorter or longer than one bar, for example, two beats or two bars. Otherwise, the frame may be determined by an absolute time.

Further, the above-mentioned frame may be variable in accordance with an automatic accompaniment tempo established by the tempo setting switch 23. In this case, it is advantageous that the frame is made longer if the tempo is fast and is made shorter if the tempo is slow.

Also, although in the foregoing embodiment, the first and second accompaniment patterns (PTRN 0, 1) are shared between two forms of tone generation so as to realize four accompaniment patterns, four independent or discrete accompaniment patterns are provided for each accompaniment style. Besides, the number of the accompaniment pattern types may be any number other than four.

Furthermore, although in the foregoing embodiment, predetermined performance data are stored in the accompaniment data memory 60, such alternative arrangement may be provided in which the memory 60 comprises a RAM so as to allow the player to write desired data thereinto, or so as to desired data to be written thereinto from external memory medium such as a magnetic tape or magnetic disk.

What is claimed is:

1. An electronic musical instrument comprising:

data memory means for storing plural accompaniment pattern data;

reading means for reading out from said data memory means one of the plural accompaniment pattern data;

performance operating member means whose operation controls a tone to be generated;

performance state detecting means for detecting a performance state carried out on said operating member means and producing performance state data representing the detected performance state;

comparing means for comparing the performance state data with a predetermined reference value;

pattern changing means for changing accompaniment pattern data to be read out from said data memory, from accompaniment pattern data being currently read out to another one of the plural accompaniment pattern data in response to a result of comparison by said comparing means, said another accompaniment pattern data being changed in accordance with a predetermined priority order given to said plural accompaniment pattern data, and accompaniment tone signal generating means for generating an accompaniment tone signal in accordance the accompaniment pattern data read out from said data memory means.

2. An electronic musical instrument as defined in claim 1, wherein said predetermined priority order is selected one of plural kinds of priority orders.

3. An electronic musical instrument as defined in claim 2, wherein said comparing means compares the performance state data with plural different reference values each having a predetermined comparison condition, and wherein said plural kinds of priority orders correspond to said plural different reference values, and wherein said pattern changing means changes the accompaniment patterns in accordance with one of the plural kinds of priority orders which corresponds to a satisfied comparison condition.

4. An electronic musical instrument as defined in claim 3, wherein said plural reference values include first and second reference values and said plural priority orders include first and second priority orders, and wherein when said performance state data satisfies the comparison condition for the first reference value, said pattern changing means changes the accompaniment patterns in said first priority order, and when said performance state data satisfies the comparison condition for the second reference value, said pattern changing means changes the accompaniment patterns in said second priority order.

5. An electronic musical instrument as defined in claim 3, wherein when said performance state data satisfies the comparison condition for the first reference value, said pattern changing means changes the accompaniment patterns in said second priority order, and when said performance state data satisfies the comparison condition for the second reference value, said pattern changing means changes the accompaniment patterns in said first priority order.

6. An electronic musical instrument as defined in claim 1, wherein said performance state detecting means detects the performance state relating to a predetermined performance operation factor over a predetermined period, and it produces the performance state data on the basis of thus detected performance state.

7. An electronic musical instrument as defined in claim 1, wherein said performance operating member means comprises a keyboard having plural keys, and said performance state represents the number of depressed keys on the keyboard.

8. An electronic musical instrument as defined in claim 1, wherein said performance operating member means comprises a keyboard, and said performance state represents a degree of a key touch on the keyboard.

9. An electronic musical instrument as defined in claim 1, wherein said plural accompaniment patterns include plural normal patterns and plural arrange-patterns corresponding to the normal patterns, each of said arrange-patterns being formed by adding one or more predetermined additional tones to corresponding one of the normal patterns.

10. An electronic musical instrument as defined in claim 1, which further includes index making means for making an increase/decrease index that indicates whether the performance state is in an increasing trend or in a decreasing trend with respect to the predetermined reference value, and pattern controlling means for controlling a manner of the change of the plural accompaniment patterns in accordance with said increase/decrease index.

11. An electronic musical instrument as defined in claim 1, which further includes sensitivity adjusting means for modifying at least one of said reference value and said performance state data, thereby allowing pattern change sensitivity to be adjusted.

12. An electronic musical instrument as defined in claim 1, which further includes sensitivity adjusting means for modifying at least one of said reference value and said performance state data in accordance with a tone color, thereby allowing pattern change sensitivity to be adjusted in accordance with the tone color.

13. An electronic musical instrument as defined in claim 1, wherein said performance operating member means comprises a first operating member means suitable for a melody performance and a second operating member means suitable for an accompaniment performance, and said performance state detecting means detects a performance state of at least one of said first and second operating member means.

14. An electronic musical instrument as defined in claim 1, which further comprises accompaniment style designating means for designating one of plural accompaniment styles, and wherein said data memory means stores the plural accompaniment pattern data for each of the plural accompaniment styles, and said reading means reads out from said data memory means one of the plural accompaniment pattern data belonging to the accompaniment style designated by said accompaniment style designating mean.

15. An electronic musical instrument comprising:

data memory means for storing plural accompaniment pattern data;

reading means for reading out from said data memory means one of the plural accompaniment pattern data means;

performance operating member means whose operation controls a tone to be generated;

performance state detecting means for detecting a performance state carried out on said operating member means and producing performance state data representing the detected performance state;

comparing means for comparing the performance state data with a predetermined reference value;

pattern changing means for changing accompaniment pattern data to be read out from said data memory over time, from accompaniment pattern data being currently read out to a different one of the plural accompaniment pattern data in response to a result of comparison by said comparing means, said another accompaniment pattern data being determined based on said currently read out accompaniment pattern data, and accompaniment tone signal generating means for generating an accompaniment tone signal in accordance the accompaniment pattern data read out from said data memory means.

16. An electronic musical instrument as defined in claim 15, wherein said performance state detecting means detects the performance state relating to a predetermined performance operation factor over a predetermined period, and it produces the performance state data on the basis of thus detected performance state.

17. An electronic musical instrument as defined in claim 15, wherein said performance operating member means comprises a keyboard having plural keys, and said performance state represents the number of depressed keys on the keyboard.

18. An electronic musical instrument as defined in claim 15, wherein said performance operating member means comprises a keyboard, and said performance state represents a degree of a key touch on the keyboard.

19. An electronic musical instrument as defined in claim 15, wherein said plural accompaniment patterns include plural normal patterns and plural arrange-patterns corresponding to the normal patterns, each of said arrange-patterns being formed by adding one or more predetermined additional tones to corresponding one of the normal patterns.

20. An electronic musical instrument as defined in claim 15, which further includes index making means for making an increase/decrease index that indicates whether the performance state is in an increasing trend or in a decreasing trend with respect to the predetermined reference value, and pattern controlling means for controlling a manner of the change of the plural accompaniment patterns in accordance with said increase/decrease index.

21. An electronic musical instrument as defined in claim 15, which further includes sensitivity adjusting means for modifying at least one of said reference value and said performance state data, thereby allowing pattern change sensitivity to be adjusted.

22. An electronic musical instrument as defined in claim 15, which further includes sensitivity adjusting means for modifying at least one of said reference value and said performance state data in accordance with a tone color, thereby allowing pattern change sensitivity to be adjusted in accordance with the tone color.

23. An electronic musical instrument as defined in claim 15, wherein said performance operating member means comprises a first operating member means suitable for a melody performance and a second operating member means suitable for an accompaniment performance, and said performance state detecting means detects a performance state of at least one of said first and second operating member means.

24. An electronic musical instrument as defined in claim 15, which further comprises accompaniment style designating means for designating one of plural accompaniment styles, and wherein said data memory means stores the plural accompaniment pattern data for each of the plural accompaniment styles, and said reading means reads out from said data memory means one of the plural accompaniment pattern data belonging to the accompaniment style designated by said accompaniment style designating mean.

25. An electronic musical instrument comprising:

data memory means for storing plural accompaniment pattern data;

reading means for reading out from said data memory means one of the plural accompaniment pattern data means;

performance operating member means whose operation controls a tone to be generated;

performance state detecting means for detecting a performance state carried out on said operating member means and producing performance state data representing the detected performance state;

comparing means for comparing the performance state data with a predetermined reference value;

pattern changing means for changing accompaniment pattern data to be read out from said data memory over time, from accompaniment pattern data being currently read out to another one of the plural accompaniment pattern data in response to a result of comparison by said comparing means, said another accompaniment pattern data being determined under a predetermined change condition, and sensitivity adjusting means for changing said predetermined change condition to another change condition, so as to adjust sensitivity of accompaniment pattern change.

26. An electronic musical instrument as defined in claim 25, in which said sensitivity adjusting means further includes change condition selecting means for selecting one change condition from plural change conditions, said predetermined change condition being one of said plural change conditions and said another change condition being another one of said plural change conditions, and modifying means for modifying at least one of said reference value and said performance state data in accordance with the selected change condition.

27. An electronic musical instrument as defined in claim 25, wherein said sensitivity adjusting means comprises tone color designating means for designating a tone color of a tone to be generated, and modifying means for modifying least one of said reference value and said performance state data in accordance with the designated tone color.

28. An electronic musical instrument as defined in claim 25, wherein said sensitivity adjusting means comprises change evaluation value generating means for generating a change evaluation value that varies depending on whether or not the accompaniment pattern has been changed in a predetermined previous period, and modifying means for modifying at least one of said reference value and said performance state data in accordance with the change evaluation value.

29. An electronic musical instrument as defined in claim 28, wherein said change evaluation value generating means generates such a change evaluation value that the change of the accompaniment patterns is controlled in a greatest degree when the accompaniment pattern has been changed by said pattern changing means in a most recent predetermined previous period.

30. An electronic musical instrument as defined in claim 25, further including index making means for making an increase/decrease index that indicates whether the performance state is in an increasing trend or in a decreasing trend with respect to the predetermined reference value, and pattern controlling means for controlling a manner of the change of the plural accompaniment patterns in accordance with said increase/decrease index, and wherein said sensitivity adjusting means modifies the increase/decrease index to change the change condition.

31. An electronic musical instrument as defined in claim 25, wherein said sensitivity adjusting means includes coefficient generating means for generating a coefficient, and modifying means for modifying at least one of said reference value and said performance state data through a calculation utilizing the coefficient.

32. An electronic musical instrument as defined in claim 25, wherein said sensitivity adjusting means includes selection signal generating means for generating a selection signal, and modifying means for modifying at least one of said reference value and said performance state data in accordance with said selection signal.

33. An electronic musical instrument as defined in claim 25, wherein said performance state detecting means detects the performance state relating to a predetermined performance operation factor over a predetermined frame, and it produces the performance state data on the basis of thus detected performance state.

34. An electronic musical instrument as defined in claim 25, wherein said performance operating member means comprises a keyboard having plural keys, and said performance state data represent the number of depressed keys on the keyboard, said performance state detecting means detecting the number of the depressed key over the predetermined period.

35. An electronic musical instrument as defined in claim 25, wherein said performance operating member means comprises a keyboard having plural keys, and said performance state data represent a degree of a key touch on the keyboard, said performance state detecting means detecting the degree of the key touch over the predetermined period.

36. An electronic musical instrument as defined in claim 25, wherein said performance operating member means comprises a keyboard having plural keys, and said performance state data represent the number of depressed keys on the keyboard, said performance state detecting means detecting a difference of the numbers of depressed keys between different periods and producing data representing the detected difference as the performance state data.

37. An electronic musical instrument as defined in claim 25, wherein said performance operating member means comprises a keyboard having plural keys, and said performance state data represent a difference of degrees of key touches on the keyboard, said performance state detecting means detecting a difference of average key touch degrees between different periods and producing data representing the detected difference as the performance state data.

38. An electronic musical instrument as defined in claim 25, which further comprises accompaniment style designating means for designating one of plural accompaniment styles, and wherein said data memory means stores the plural accompaniment pattern data for each of the plural accompaniment styles, and said reading means reads out from said data memory means one of the plural accompaniment pattern data belonging to the accompaniment style designated by said accompaniment style designating means.

39. An electronic musical instrument comprising:

first performance operating member means whose operation controls a first tone to be generated;

second performance operating member means whose operation controls a second tone to be generated;

data memory means for storing plural accompaniment pattern data;

reading means for reading out one of the plural accompaniment pattern data from said data memory means;

first tone signal generating means for generating a tone signal corresponding to said first tone;

second tone signal generating means for generating a tone signal corresponding to said second tone in accordance with the accompaniment pattern data;

first performance state detecting means for detecting a performance state carried out on said first performance operating member means and producing first performance state data representing the detected performance state;

second performance state detecting means for detecting a performance state carried out on said second performance operating member means and producing second performance state data representing the detected performance state;

selecting means for selecting one of said first and second performance state data;

comparing means for comparing the selected performance state data with a predetermined reference value, and pattern changing means for changing accompaniment pattern data to be read out from said data memory, from accompaniment pattern data being currently read out to a different one of the plural accompaniment patterns in accordance with a result of comparison by said comparing means.

40. An electronic musical instrument comprising:

first performance operating member means for inputting performance data for controlling a first tone generation;

second performance operating member means for inputting performance data for controlling a second tone generation;

data memory means for storing plural accompaniment pattern data;

reading means for reading out one of the plural accompaniment pattern data from said data memory means;

first tone signal generating means for generating a tone signal corresponding to said first tone;

second tone signal generating means for generating a tone signal corresponding to said second tone in accordance with the accompaniment pattern data;

first performance state detecting means for detecting a performance state carried out on said first performance operating member means and producing first performance state data representing the detected performance state;

second performance state detecting means for detecting a performance state carried out on said second performance operating member means and producing second performance state data representing the detected performance state;

data making means for making third performance state data on the basis of said first and second performance state data;

selecting means for selecting one of said first, second and third performance state data;

comparing means for comparing the selected performance state data with a predetermined reference value; and pattern changing means for changing accompaniment pattern data to be read out from said data memory, from accompaniment pattern data being currently read out to another one of the plural accompaniment patterns in accordance with a result of comparison by said comparing means.

* * * * *

UNITED STATES PATENT AND TRADEMARK OFFICE

CERTIFICATE OF CORRECTION

PATENT NO. : 5,241,128

DATED : August 31, 1993

INVENTOR(S) : TSUTOMU IMAIZUMI, ET AL.

It is certified that error appears in the above-identified patent and that said Letters Patent is hereby corrected as shown below:

On the title page, Item [75]: Inventors, the inventor's first name is misspelled as "Yashushi" Kurakake.

The second inventor's correct first name is --Yasushi--

Kurakake.

Signed and Sealed this

Thirty-first Day of May, 1994

Bruce Lehman

*Attest:*

BRUCE LEHMAN

*Attesting Officer*

*Commissioner of Patents and Trademarks*